US006515433B1

(12) United States Patent
Ge et al.

(10) Patent No.: US 6,515,433 B1
(45) Date of Patent: Feb. 4, 2003

(54) GAS DISCHARGE FLUORESCENT DEVICE

(75) Inventors: Shichao Ge, San Jose, CA (US); Xi Huang, San Jose, CA (US); Ivan Chan, Hong Kong (HK)

(73) Assignee: Coollite International Holding Limited, Hong Kong (HK)

( * ) Notice: Subject to any disclaimer, the term of this patent is extended or adjusted under 35 U.S.C. 154(b) by 0 days.

(21) Appl. No.: 09/658,070

(22) Filed: Sep. 11, 2000

(30) Foreign Application Priority Data

| | | |
|---|---|---|
| Sep. 11, 1999 | (CN) | 99242974 U |
| Sep. 11, 1999 | (CN) | 99243088 U |
| Sep. 20, 1999 | (CN) | 99243281 U |
| Sep. 30, 1999 | (CN) | 99121125 A |
| May 29, 2000 | (CN) | 00235546 U |
| Jul. 19, 2000 | (CN) | 00242298 U |

(51) Int. Cl.[7] ..... H05B 37/00

(52) U.S. Cl. ..... 315/227 R; 315/246; 315/58; 315/59; 313/491; 313/493; 313/607; 362/216; 362/218; 362/377

(58) Field of Search ..... 315/169.1, 160, 315/167, 177, 180, 291, 278, 312, DIG. 5, 227 R, 246, 241 R, 58, 59, 71; 313/113, 317, 493, 573, 610, 491, 485; 362/377, 223, 216, 218

(56) References Cited

U.S. PATENT DOCUMENTS

| | | | | |
|---|---|---|---|---|
| 2,171,359 A | 8/1939 | Gerter | | 176/1 |
| 3,833,833 A | 9/1974 | Nelson | | 315/169 TV |
| 4,029,984 A | 6/1977 | Endriz | | 313/96 |

(List continued on next page.)

FOREIGN PATENT DOCUMENTS

| | | |
|---|---|---|
| CN | 1123945 | 6/1996 |
| CN | 95116709 | 3/1997 |
| EP | 0151850 | 8/1985 |
| EP | 0330808 | 9/1989 |
| EP | 0331660 | 9/1989 |
| EP | 0348979 | 1/1990 |
| EP | 0840353 | 5/1998 |
| JP | 62-157657 | 7/1987 |
| JP | 01315787 | 12/1989 |
| JP | 07-43680 | 2/1995 |
| JP | 09-92210 | 4/1997 |

(List continued on next page.)

OTHER PUBLICATIONS

*Flat–Panel Displays and CRTs,* edited by Lawrence E. Tannas Jr., Von Nostrand Reinhold, New York, NY 1985, p. 339.

"Efficiency Limits for Fluorescent Lamps and Application to LCD Backlighting," R.Y. Pai, *Journal of the SID,* 5/4, 1997, pp. 371,374.

"28.5 Large–Area Color Display 'Skypix'," Yoshiyasu Sakaguchi et al., *SID 91 Digest,* 1991, pp. 557,579.

(List continued on next page.)

*Primary Examiner*—Haissa Philogene

(74) *Attorney, Agent, or Firm*—James S. Hsue; Skjerven Morrill LLP

(57) ABSTRACT

Sputtering of the cathodes of a cold cathode fluorescent lamp is reduced or eliminated by removing electrodes altogether from the sealed envelope containing the gaseous medium. Electric field is then applied by means of electrically conductive members outside the tube. Alternatively, the current passing between electrodes can be spread over multiple sub-electrodes so that the current flow and sputtering experienced by each individual sub-electrode will be reduced. Different designs are employed to facilitate heat dissipation for high power and high intensity cold cathode fluorescent lamp applications. Thus, a container for the fluorescent lamp tube may be omitted altogether and adjacent rounds of a spiral-shaped lamp may be attached together by an adhesive material. Alternatively, the container may be open at one end to facilitate heat dissipation. Or the container for the lamp and the housing from the driver may each contain a hole to allow air circulation to carry away heat.

83 Claims, 18 Drawing Sheets

U.S. PATENT DOCUMENTS

| | | | | | |
|---|---|---|---|---|---|
| 4,099,096 | A | | 7/1978 | Holz et al. | 315/169 TV |
| 4,558,400 | A | | 12/1985 | Buser | 362/222 |
| 4,625,152 | A | | 11/1986 | Nakai | 315/317 |
| 4,750,096 | A | | 6/1988 | Lim | 362/218 |
| 4,767,193 | A | | 8/1988 | Ota et al. | 350/345 |
| 4,816,719 | A | * | 3/1989 | Maya et al. | 313/610 |
| 4,839,564 | A | | 6/1989 | Ide et al. | 315/169.4 |
| 4,934,768 | A | | 6/1990 | Blaisdell | 313/1 |
| 4,937,487 | A | | 6/1990 | Blaisdell et al. | 313/318 |
| 5,032,765 | A | | 7/1991 | Nilssen | 315/97 |
| 5,093,698 | A | | 3/1992 | Egusa | 357/17 |
| 5,103,133 | A | * | 4/1992 | Misono | 313/491 |
| D334,242 | S | | 3/1993 | Imamura et al. | D26/1 |
| 5,191,259 | A | | 3/1993 | Hayashi et al. | 313/497 |
| D334,990 | S | | 4/1993 | Sekiguchi et al. | D26/1 |
| 5,216,324 | A | | 6/1993 | Curtin | 313/495 |
| 5,220,249 | A | | 6/1993 | Tsukada | 315/246 |
| 5,317,169 | A | | 5/1994 | Nakano et al. | 257/40 |
| 5,387,837 | A | | 2/1995 | Roelevink et al. | 313/484 |
| 5,424,560 | A | | 6/1995 | Norman et al. | 257/40 |
| 5,457,312 | A | | 10/1995 | Mansour | 250/222.2 |
| 5,457,565 | A | | 10/1995 | Namiki et al. | 359/273 |
| 5,502,626 | A | | 3/1996 | Armstrong et al. | 362/216 |
| 5,514,934 | A | | 5/1996 | Matsumoto et al. | 313/607 |
| 5,668,443 | A | | 9/1997 | Kawaguchi et al. | 315/169.1 |
| 5,801,483 | A | * | 9/1998 | Watanabe et al. | 313/485 |
| 5,850,122 | A | | 12/1998 | Winsor | 313/473 |
| 6,135,620 | A | * | 10/2000 | Marsh | 362/377 |
| 6,201,352 | B1 | * | 3/2001 | Ge et al. | 315/169.1 |
| 6,211,612 | B1 | * | 4/2001 | Ge | 313/493 |
| 6,310,436 | B1 | | 10/2001 | Ge et al. | 313/493 |
| 6,337,543 | B1 | | 1/2002 | Ge | 315/227 R |

FOREIGN PATENT DOCUMENTS

| | | |
|---|---|---|
| WO | WO94/29895 | 12/1994 |
| WO | WO95/22835 | 8/1995 |
| WO | WO97/38410 | 10/1997 |
| WO | WO99/57749 | 11/1999 |

OTHER PUBLICATIONS

"S11–3 Study to Improve the Flood–Beam CRT for Giant Screen Display," M. Morikawa et al., *Japan Display '92,* 1992, pp. 385–388.

"8.2: A High–Resolution High–Brightness Color Video Display for Outdoor Use," N. Shiramatsu et al., *SID 89 Digest,* 1989, pp. 102–105.

International Search Report mailed Jan. 17, 2001.

* cited by examiner

GAS DISCHARGE FLUORESCENT DEVICE

CROSS-REFERENCE TO RELATED APPLICATIONS

This application is related to U.S. patent application Ser. No. 09/073,738, filed May 6, 1998 now U.S. Pat. No. 6,310,436, U.S. patent application Ser. No. 09/467,206, filed Dec. 20, 1999 now U.S. Pat. No. 6,337,543, and International Patent Application No. PCT/US99/09856, filed May 5, 1999. These three applications are incorporated herein by reference in their entireties.

BACKGROUND OF THE INVENTION

This invention relates in general to gas discharge fluorescent devices, and, in particular, to an improved cold cathode gas discharge fluorescent device. Many of the features of this invention are useful, in particular, for delivering higher intensity illumination.

Hot cathode fluorescent lamps (HCFLs) have been used for illumination. While HCFLs are able to deliver high power, the useful life of HCFLs is typically in the range of several thousand hours. For many applications, it may be costly or inconvenient to replace HCFLs when they become defective after use. It is therefore desirable to provide illumination instruments with a longer useful life. The cold cathode fluorescent lamp (CCFL) is such a device with a useful life in the range of about 20,000 to 50,000 hours.

HCFL and CCFL employ entirely different mechanisms to generate electrons. The HCFL operates in the arc discharge region whereas the CCFL functions in the normal glow region. This is illustrated on page 339 from the book *Flat Panel Displays and CRTS*, edited by Lawrence E. Tannas, Jr., Von Nostrand Reinhold, New York, 1985, which is incorporated herein by reference. The HCFL functions in the arc discharge region. As shown in FIG. 10-5 on page 339 of this book, for the HCFL functioning in the arc discharge region, the current flow is of the order of 0.1 to 1 ampere. The CCFL functions in the normal glow region. Functioning in the normal glow region of the gas discharge, the current flow in the CCFL is of the order of $10^{-3}$ ampere, according to FIG. 10-5 on page 339 of the above-referenced book. Thus, the current flow in the HCFL is about two orders of magnitude or more than that in the CCFL.

The HCFL typically employs a tungsten coil coated with an electron emission layer. For more details, see page 61 of *Applied Illumination Engineering, Second Edition*, Jack L. Lindsey, 1997, published by The Fairmont Press, Inc. in Lilburn, GA 30247, which is incorporated herein by reference. More than 1 watt of power is needed to heat the tungsten coil to about 900° C. At this temperature, the electrons can easily leave the electron emission layer and a small voltage of the order of about 10 volts will pull large currents into the discharge. The large current flow is in the form of a visible arc, so that the HCFL is also known as the arc lamp. The small voltage will also pull ions from the discharge which return to the tungsten coil, thereby ejecting secondary electrons. However, since the cathode-fall voltage (~10 V) is small, the sputtering effect of such ions would be small. The lifetime of an HCFL is determined primarily by the evaporation of the electron emission layer at the high operating temperature of the HCFL.

The CCFL emit electrons by a mechanism that is entirely different from that of the HCFL. Instead of employing an electron emission layer and heating the cathode to a high temperature to make it easy for electrons to leave the cathode, the CCFL relies on a high cathode-fall voltage (~150 V) to pull ions from the discharge. These ions eject secondary electrons from the cathode and the cathode-fall then accelerates the secondary electrons back into the discharge producing several electron-ion pairs. Ions from these pairs return to the cathode. Because of the high cathode-fall voltage (~150 V), the ions are accelerated by the cathode-fall voltage from the discharge to the cathode, thereby causing sputtering. Different from the HCFL, no power is wasted to heat the CCFL to a high temperature before light can be generated by the lamp.

The HCFL operates at a relatively low voltage (~100 V) whereas the CCFL operates at high voltages (of the order of several hundred volts). The HCFL operates at a temperature of about 40° C. and above, with the cathode operating at a relatively high temperature of about 900° C, whereas the CCFL operates in a temperature range of about 30–75° C., with the cathode operating at a temperature of about 80–150° C. For further information concerning the differences between HCFL and a CCFL, please see the paper entitled "Efficiency Limits for Fluorescent Lamps and Application to LCD Backlighting," by R. Y. Pai, *Journal of the SID*, May 4, 1997, pp. 371–374, which is incorporated herein by reference.

CCFLs typically comprise an elongated tube and a pair of electrodes where the current between the electrodes in the CCFL is not more than about 5 milliamps and the power delivered by the CCFLs less than about 5 watts. In order to increase the power delivered by the CCFL, it is possible to increase either the length of (and consequently, the voltage across the CCFL) or the current in the CCFL. It may be difficult to manufacture CCFLs whose tubes are excessively long. Furthermore, when the tube length of the CCFL is excessive, they must be operated at high voltage so that this increases the cost and reduces the reliability of the CCFL drivers. Another way to increase the power output of the CCFL is to increase the current in the CCFL. However, as noted above, because of the high cathode-fall voltage which may be about 150 V, ions are accelerated from the discharge towards the cathode, thereby causing sputtering. This means that if a large current is flowing in the CCFL, the return of the ions to the cathode may cause excessive sputtering, which drastically reduces the useful life of the CCFL.

The metal from the cathode that is sputtered may also combine with the gas medium in the CCFL, such as mercury, to form a mercury alloy on the wall containing the gaseous medium, thereby reducing the amount of mercury present in the medium to the extent that the CCFL may become defective for the reason that there is not enough mercury left for generating gas discharge in the gaseous medium. Furthermore, the heat generated at the cathode will need to be dissipated. Since the cathode and the gaseous medium are typically enclosed in a sealed envelope, it may be difficult for the heat to be effectively dissipated so that the cathode temperature may reach a 110° C. or above. Thus the cathode, the gaseous medium and the envelope are all at elevated temperatures which may reduce the useful life of the CCFL. Moreover, the conventional CCFL design requires connecting wires to pass through the envelope to connect the electrodes to a driver, while maintaining a vacuum seal of the gaseous medium within the envelope. This may be costly, cumbersome to produce and reduces the effective yield in production.

For the reasons explained above, CCFLs have not been used as high power illumination systems for delivering high intensities. As noted above, the power delivered by CCFLs is generally less above 5 watts. Even though the CCFL is more efficient than incandescent lamps, the maximum intensity that can be delivered by conventional CCFLs would be less than that generated by a 25 watt incandescent lamp. For this reason, CCFLs have not been used for illumination purposes and have not been used to replace incandescent lamps. On the other hand, CCFLs are much more energy efficient than incandescent lamps and have a much longer useful life. Therefore, it is desirable to provide an improved cold cathode gas discharge system that can be used at high power to deliver high intensity illumination while retaining its advantages of energy efficiency and longer useful life.

SUMMARY OF THE INVENTION

For the purpose of delivering high intensity illumination, CCFL designers need to solve two problems: sputtering of the cathode material caused by the cathode-fall voltage and the dissipation of heat.

To reduce the amount of cathode material that is sputtered during the gas discharge, at least one of the electrodes may be removed from the gas discharge medium; preferably, both electrodes are removed so that there is no electrode present in the gas discharge medium and an AC voltage is applied to the gas medium by means of electrically conductive members outside the medium. This would entirely eliminate the sputtering problem.

When the conventional CCFL is operated at high power, large currents will flow between the pair of electrodes in the CCFL, and as noted above, the return of the ions to the cathode may cause excessive sputtering which drastically reduces the useful life of the CCFL. An alternative solution for solving the sputtering problem is to spread out the large current over more than one pair of cathodes so that the amount of current flow through any one particular cathode would be reduced, thereby also reducing the sputtering experienced by each individual cathode. Preferably, current limiting devices may be used to connect the driver to the multiple cathodes.

A cold cathode gas discharge fluorescent device includes at least one cold cathode fluorescent lamp and a driver supplying power to the at least one lamp to cause it to emit light. The driver is typically housed in a housing and a light transmitting container is used to contain the at least one lamp, where the container is connected to and forms a chamber with the housing to house the at least one lamp. Where the at least one lamp is operated at high power, much heat would be generated during the operation so that an important concern is heat dissipation. Heat dissipation may be enhanced by a number of different features some of which may be used separately or in conjunction with one another.

One feature for enhancing heat dissipation is to provide a hole in the housing as well as the container to allow air circulation between the chamber and the environment to dissipate heat generated by the at least one lamp.

Another possible design is to employ a container for the at least one lamp where the container is open at one end to allow better heat dissipation.

Yet another possible design is to omit the container altogether. The container lends mechanical strength to the fluorescent gas discharge device. Where no container is employed at all for housing the at least one lamp, and where the at least one lamp is in the shape of a spiral, means is provided for attaching at least two adjacent rounds of the at least one lamp to one another to increase mechanical strength of the gas discharge device.

Other desirable features of the invention pertain to designs to increase light intensity delivered by the device. Thus in one design, the portion of the housing proximate to the container is larger in dimensions than the portion of the housing distal from the container. This permits a larger container to be used for housing a longer and/or larger or multiple cold cathode fluorescent lamps.

In another design, the at least one lamp has a cylindrical envelope substantially in the shape of a spiral. The container has a first section proximate to the housing and a distal second section away from the housing larger than the first section. This permits the container to hold a spiral lamp of larger diameter. The device preferably has a light emitting window that is larger than 50% of the area enclosed by the spiral.

BRIEF DESCRIPTION OF THE DRAWINGS

For simplicity in description, identical components are labeled by the same numerals in this application.

DETAILED DESCRIPTION OF THE EMBODIMENTS

Figure 1:
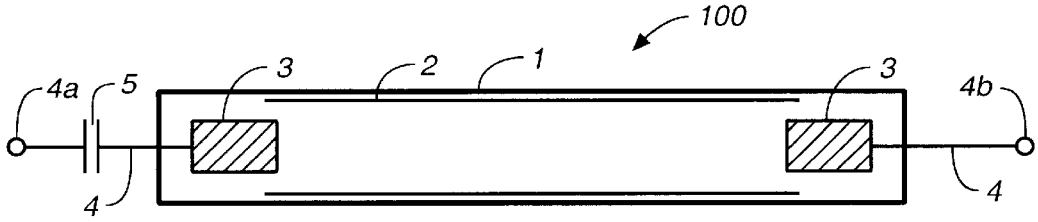
FIG. 1 (PRIOR ART)
FIG. 1 is a schematic view of a cold cathode gas discharge system to illustrate a conventional CCFL.

FIG. 1 is a schematic view of a conventional CCFL 100. As shown in FIG. 1, CCFL 100 includes a vacuum sealed gas discharge tube 1, which contains gas discharge material such as mercury, xenon and one or more inert gases such as argon, helium, neon or other inert gases. On the inner wall of tube 1 is a fluorescent layer 2. Tube 1 also contains two electrodes 3, one at each end of the tube. A lead 4 for each electrode connects corresponding electrode 3 and passes through one of the ends of tube 1 to outside the tube. One of the leads 4 connects its corresponding electrode 3 through capacitor 5 to a node 4*a*, while the other lead 4 connects the remaining electrode 3 to lead 4*b*. When an appropriate AC voltage is applied between nodes 4*a*, 4*b*, such as an AC voltage at about 30 kHz, the gas discharge in tube 1 generates ultraviolet radiation which excites the phosphor layer 2 to generate visible light. Typically, the current flowing through electrodes 3 is controlled to be less than 5 milliamps because of the sputtering problems discussed above. If the current applied through electrodes 3 exceeds 5 milliamps, the useful life of the CCFL 100 is drastically reduced. From tests which have been conducted, the useful life of a conventional CCFL 100 varies inversely with the square of the current carried by the CCFL. For this reason, the conventional CCFL of the type shown in FIG. 1 is typically used to deliver low power, such as at below 5 watts.

Figure 2:
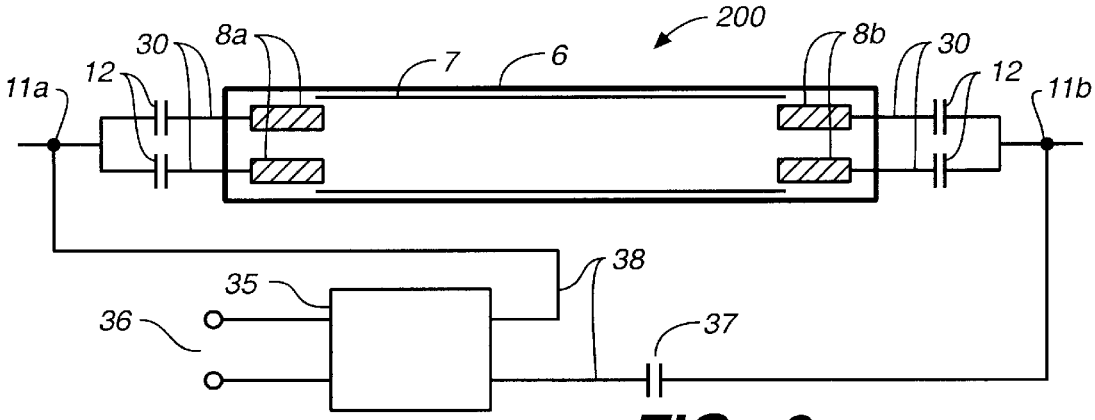
FIG. 2 is a schematic view of a cold cathode gas discharge system useful for illustrating an embodiment of the invention.

FIG. 2 is a schematic view of a cold cathode gas discharge system useful for illustrating the invention. System 200 includes a vacuum sealed container 6 such as a tube, containing gas discharge material such as mercury, xenon and one or more inert gases such as argon, helium, neon or other inert gases. An optional phosphor layer 7 may be employed on the walls of tube 6. Tube 6 contains two pairs of sub-electrodes: pair 8*a* and pair 8*b*. As shown in FIG. 2, each sub-electrode is connected through a corresponding capacitor 12 to nodes 11*a*, 11*b*. When a suitable AC voltage is applied across the nodes 11*a*, 11*b*, such as at 10–100 kHz and 100 V to 50 kV, the current flow between the two pairs of sub-electrodes would cause gas discharge and generation of ultraviolet radiation in tube 6. Where the optional phosphor layer 7 is present on the wall of tube 6, the phosphor layer is caused to generate visible light or a given wavelength ultraviolet light in response to the ultraviolet radiation. A given color visible light source or a given wavelength ultraviolet light source can then be obtained.

Since the current flow between nodes 11*a*, 11*b* is now spread across two pairs of sub-electrodes 8*a*, 8*b*, the current experienced by any individual sub-electrode is less than that passing between the two nodes, so that the sputtering effect on such sub-electrode is reduced as compared to a situation where the entire current passing between the nodes passes through such sub-electrode. Thus, if the two sub-electrodes in pair 8*a* each carries 5 milliamps of current, this enables a current of 10 milliamps to flow between nodes 11*a*, 11*b*, so that the power delivered by system 200 would be twice that of the conventional CCFL 100 carrying 5 milliamps. While each electrode is embodied in a pair of sub-electrodes (e.g. 8*a*) for a total of two pairs (8*a*, 8*b*) of sub-electrodes as shown in FIG. 2, it will be understood that each electrode may comprise more than two sub-electrodes such as n sub-electrodes may be employed to deliver 5n milliamps of current between n pairs of sub-electrodes, so that the power delivered by such device will be 5n watts, where n is a positive integer greater than 1.

A lead 30 for each sub-electrode is connected to its corresponding sub-electrode 8*a* or 8*b* and passes through one of the ends of tube 6 to outside the tube to a driver 35 and capacitor 37 through leads 38. Driver 35 receives power from a power supply (not shown) such as a power outlet connected to a power utility company through leads 36. Driver 35 converts the power received to that desirable for driving the CCFL, such as DC power or AC power in the range of, for example, 10–100 kHz and 100 V to 50 kV. Layer 7 is a phosphor layer deposited on the inner wall of the tube 6. Where a DC voltage is used to operate the CCFL, the capacitor 37 may be omitted.

When a suitable DC voltage, or a suitable AC voltage, is applied across the sub-electrodes 8*a*, 8*b* by means of a power supply and driver 35, the current flow between the two pairs of sub-electrodes would cause gas discharge and generation of ultraviolet radiation or visible light in tube 6.

Since the useful life of the sub-electrodes in a cold cathode gas discharge system varies inversely with the square of the current carried by the sub-electrodes in the system, where the operating current carried by each of the sub-electrodes in pairs 8*a*, 8*b* is reduced to 2.5 milliamps from 5 milliamps, this means that the useful life of the cold cathode gas discharge system 200 can be increased by 4 times.

Each of the sub-electrodes can have a construction similar to cathodes in a normal cold cathode gas discharge system, and can be made of metal or metal with mercury alloy and getter. The installation method of the sub-electrode can be as shown in FIG. 2, each sub-electrode having a lead 30 that passes through one of the ends of the tube 6 to outside the tube.

Figure 3:
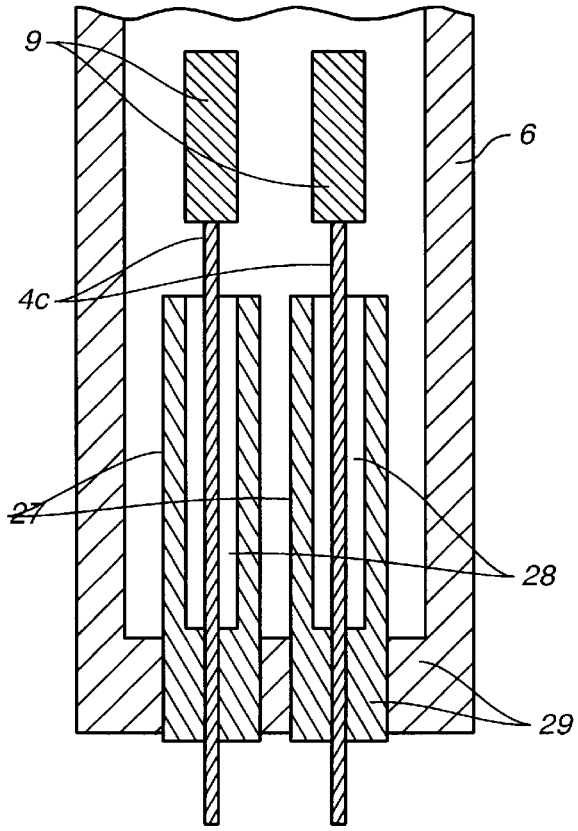
FIG. 3 is a cross-sectional view of a portion of the system of FIG. 2 to illustrate the system in more detail.

The installation method of the sub-electrode can also be as shown in FIG. 3. FIG. 3 is a cross sectional view of a pair of sub-electrodes, such as pair 8*a*, or pair 8*b*, in FIG. 2, of a cold cathode gas discharge system to illustrate a detailed construction of the system. As shown in FIG. 3, each of sub-electrodes in the pairs 8*a*, 8*b*comprises an electrode body 9*a*, lead 4*c* and a glass tube 27. As shown in FIG. 3, glass tube 27 surrounds most of its corresponding lead 4*c*, thereby leaving a corresponding gap 28 between such lead 4*c* and the tube. The gaps 28 are narrow and deep and may be used to avoid shorting between adjacent sub-electrodes caused by electrode sputtering. The glass tubes 27 may be sealingly attached with leads 4*c* to tube 6 at sealing area 29.

As shown in FIG. 2, current limiting devices 12 are employed to connect the sub-electrodes 8*a*, 8*b* to nodes 11*a*, 11*b* which are connected to a driver and an AC power supply (not shown). The function of the current limiting devices are to limit the amount of current that is delivered to the sub-electrodes. Preferably, each sub-electrode has a corresponding current limiting device that connects it to the driver and power supply, in the manner shown in FIG. 2. Thus, each of the sub-electrodes in the two pairs 8*a*, 8*b* is connected through a corresponding capacitor to a corresponding node in order to limit the amount of current that is delivered to such sub-electrode. While capacitors may be advantageously employed for coupling an AC voltage to its corresponding sub-electrode, it will be understood that other electrical components may be used instead in this and other embodiments described below, such as a resistor, an inductor, or any combination of capacitor, inductor, resistor (e.g. capacitor connected in series or parallel to a resistor). Such and other variations are within the scope of the invention.

Figure 4:
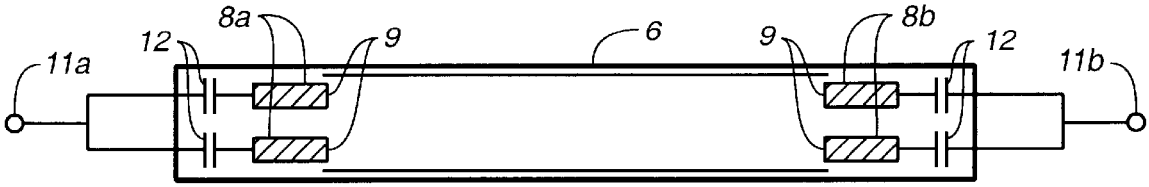
FIG. 4 is a schematic view of a cold cathode gas discharge system to illustrate an alternative embodiment to that in FIG. 2.

In FIG. 2, the current limiting devices 12 are shown as located outside tube 6. This is not essential, and these devices may be placed either inside or outside tube 6. Thus, in an alternative embodiment as shown in FIG. 4, the capacitors connecting the sub-electrode pair 8*a* to node 11*a* are placed inside the tube while the capacitors 12 connecting the pair 8*b* to node 11*b* are placed within the tube. Capacitors 12 and sub-electrode pair 8*b* may be constructed so that they form a unitary body, such as in the implementation illustrated in FIG. 5.

Figure 5:
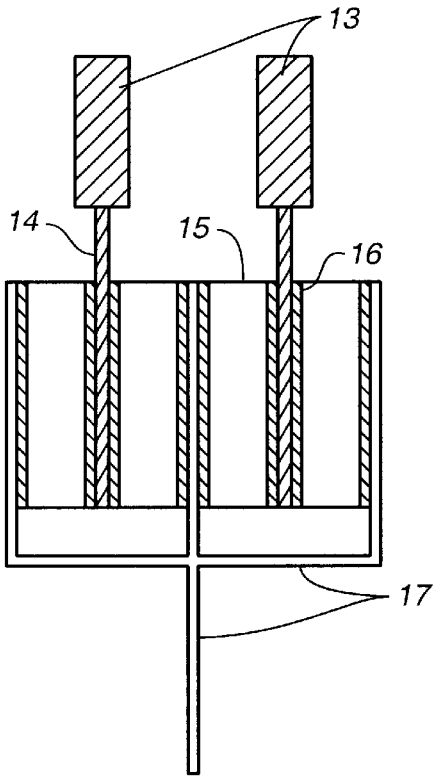
FIG. 5 is a cross-sectional view of a cathode configuration to illustrate another embodiment of the invention.
Figure 6:
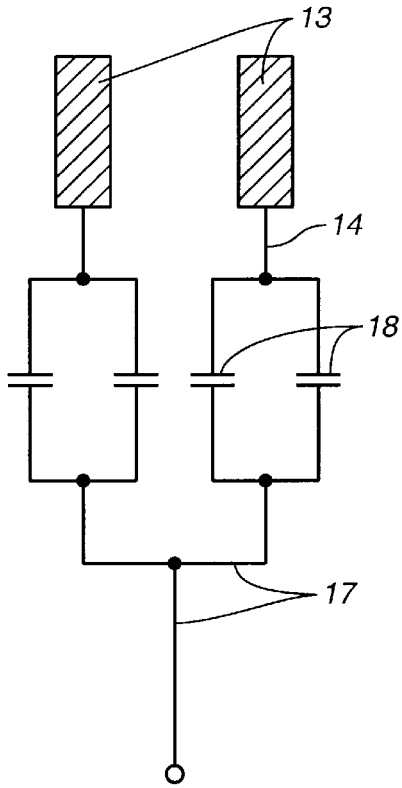
FIG. 6 is a schematic view of a circuit which is the equivalent of the electrode configuration of FIG. 5.

As shown in FIG. 5, each of the electrode structure or configuration in the sub-electrodes may include an electrode body 13, and lead 14. Each of the capacitors for such sub-electrode may be implemented as two electrically conductive layers 16 and a dielectric layer 15 between the two conductive layers 16. All of the conductive layers 16 are then connected to an electrically conductive shell 17. Thus, on each side of lead 14 are two capacitors, each formed by two electrically conductive plates 16 and a dielectric layer 15 in between, so that the two sub-electrodes and their corresponding pairs of capacitors form a unitary body as illustrated in FIG. 5. The circuit equivalent of the structure in FIG. 5 is illustrated in FIG. 6, where each of the four capacitors 18 is formed by a corresponding pair of electrically conductive plates 16 and a dielectric layer in between. By choosing the appropriate materials for layers 15, 16, the current limiting device achieved can become resistors, or a combination of capacitors and resistors.

Figure 7:
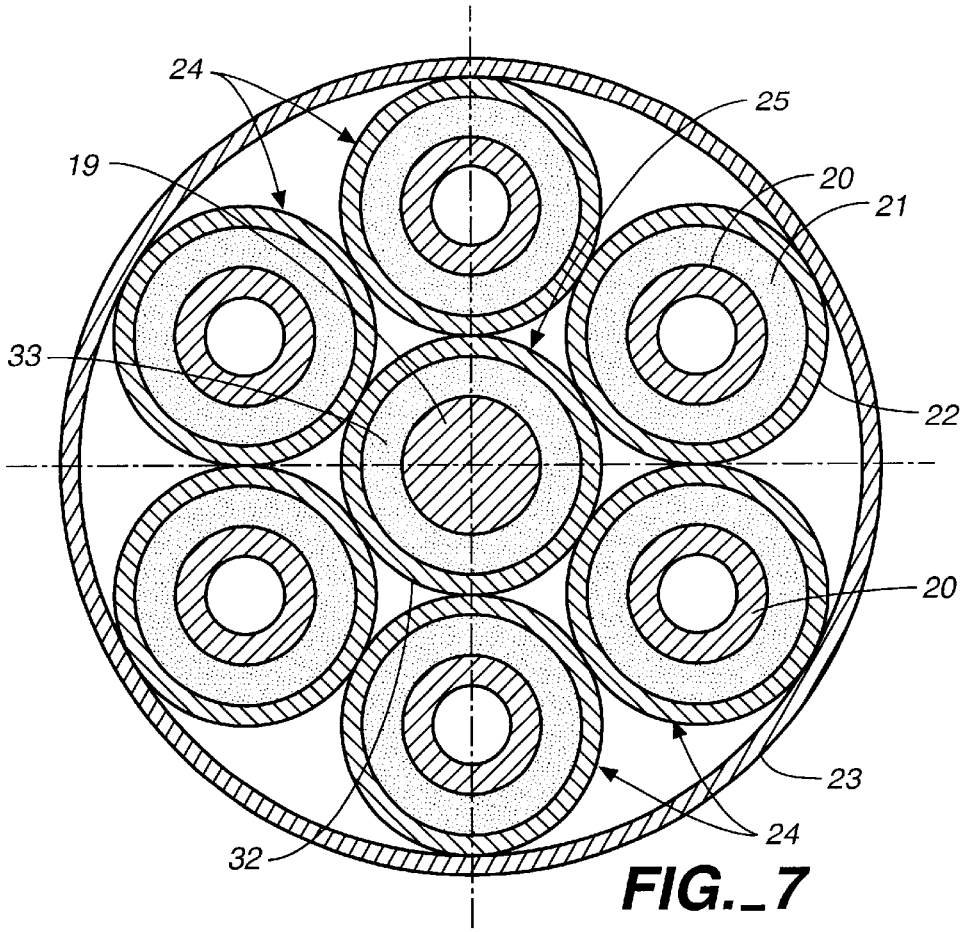
FIG. 7 is a cross-sectional view of an electrode configuration to illustrate yet another embodiment of the invention.
Figure 8:
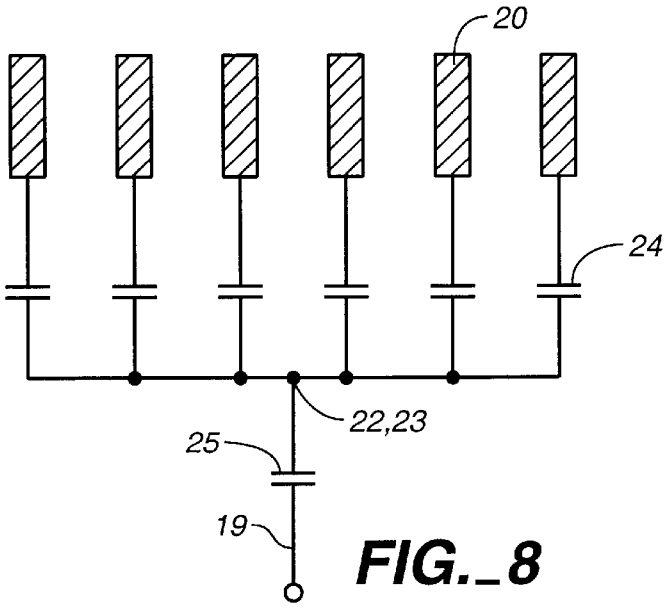
FIG. 8 is a schematic view of a circuit which is equivalent to the electrode configuration of FIG. 7.
Figure 9:
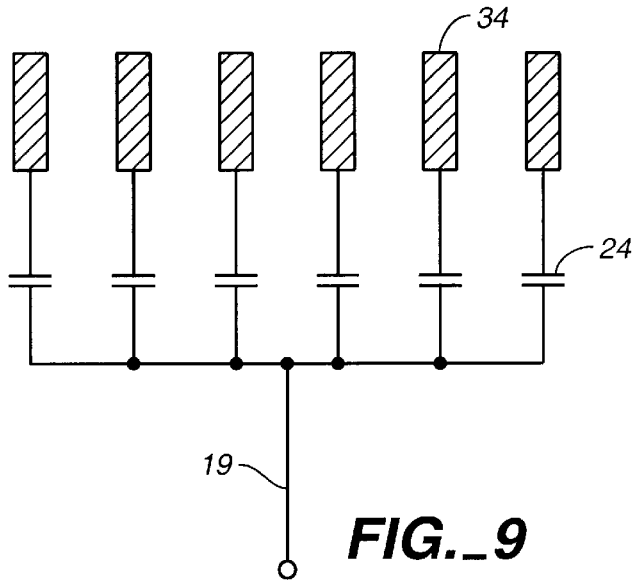
FIG. 9 is a schematic view of a circuit which is equivalent to the electrode configuration of FIG. 7, except that the series capacitor 25 of FIG. 7 has been omitted.

FIG. 7 illustrates another embodiment where a plurality of sub-electrodes and their corresponding capacitors are implemented as a unitary body. Shown in FIG. 7 is a cross-sectional view of such body. FIG. 8 is the circuit equivalent of the electrode structure in FIG. 7. As shown in FIGS. 7 and 8, lead 19 forms the connector that may be connected to a driver and an AC power supply (not shown) for supplying power to the sub-electrodes. Lead 19 is connected through a capacitor 25 to six capacitors 24, each capacitor being in the shape of a cylinder as shown in FIG. 7. Capacitor 25 is formed by lead 19 and an electrically conductive layer 32 and a dielectric layer 33 between them. The electrically conductive layer 32 of capacitor 25 is in contact with corresponding electrically conductive layers 22 of six other capacitors 24, where each capacitor 24 comprises an outer electrically conductive layer 22, an inner electrically layer 20 that also serves as the electrode body and a dielectric layer 21 sandwiched in between layers 20 and 22 as shown in FIG. 7. The entire assembly of the seven capacitors in FIG. 7 are then contained in the electrically conductive housing 23 whose inner cross-sectional dimensions are such that the outer layer 32 of capacitor 25 is in electrical contact with the outer layers 22 of the remaining six capacitors 24. The circuit equivalent of the structure of FIG. 7 is illustrated in FIG. 8. While a capacitor 25 is employed connected in series with capacitors 24 to electrode bodies 20, it will be understood that capacitor 25 may be omitted, which will not affect the operation of the sub-electrodes in a cold cathode gas discharge system. This is illustrated in FIG. 9.

Figure 10:
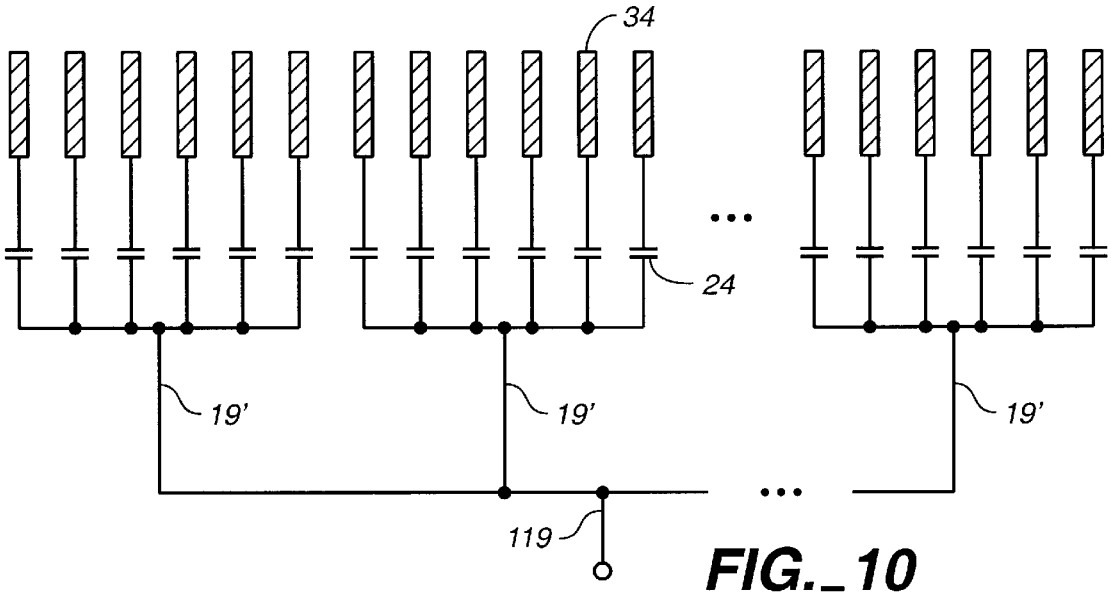
FIG. 10 is a schematic view of a circuit which may be arrived at by employing multiple electrode structures similar to that of FIG. 7.

Thus, in reference to FIGS. 7 and 8, when each of the six sub-electrodes carries 5 milliamps. of current, the six sub-electrodes together would carry 30 milliamps. The structure shown in FIG. 7 may be further extended to deliver an even higher current and therefore power in a gas discharge. Thus, if an electrical conductor 119 is electrically connected to six electrical conductors 19', and each of the six electrical conductors 19' is connected to 6 sub-electrodes in the same manner as electrical conductor 19 as shown in FIG. 7, then the total current delivered would be 6×6×5 or 180 milliamps. This is illustrated schematically in FIG. 10. By using such a tree type sub-electrode configuration, a cold cathode gas discharge system employing such structure may deliver several 100 milliamps. or over 1 ampere of current, thereby delivering high power for illumination and other purposes.

Even though sub-electrode configurations described above may be used to deliver large currents, such currents are spread over a number of sub-cathodes so that the problems caused by sputtering described above would not affect the useful life of such sub-cathodes and of the cold cathode gas discharge systems using such sub-electrodes. As compared to existing HCFL and CCFL designs, the invention is advantageous in that it is a simple and compact in structure and may be used to deliver high power and yet has a long useful life.

Figure 11:
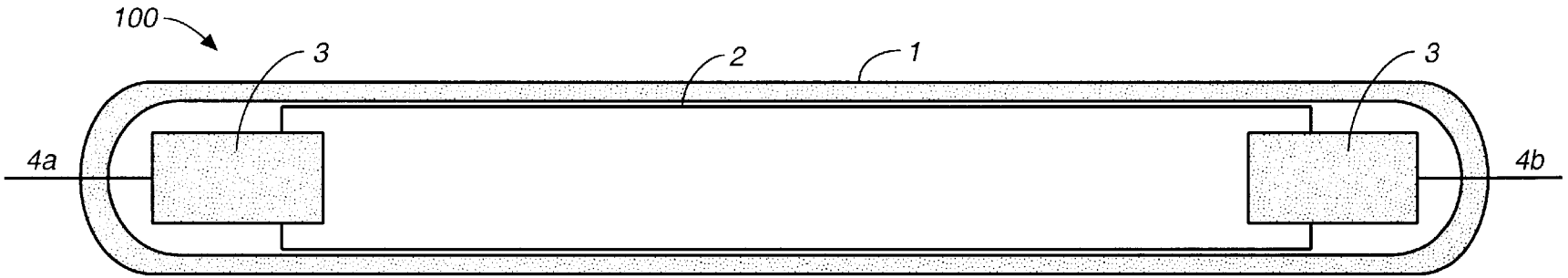
FIG. 11 (PRIOR ART)
FIG. 11 is a cross-sectional view of a conventional CCFL similar in design to that shown in FIG. 1.
Figure 12:
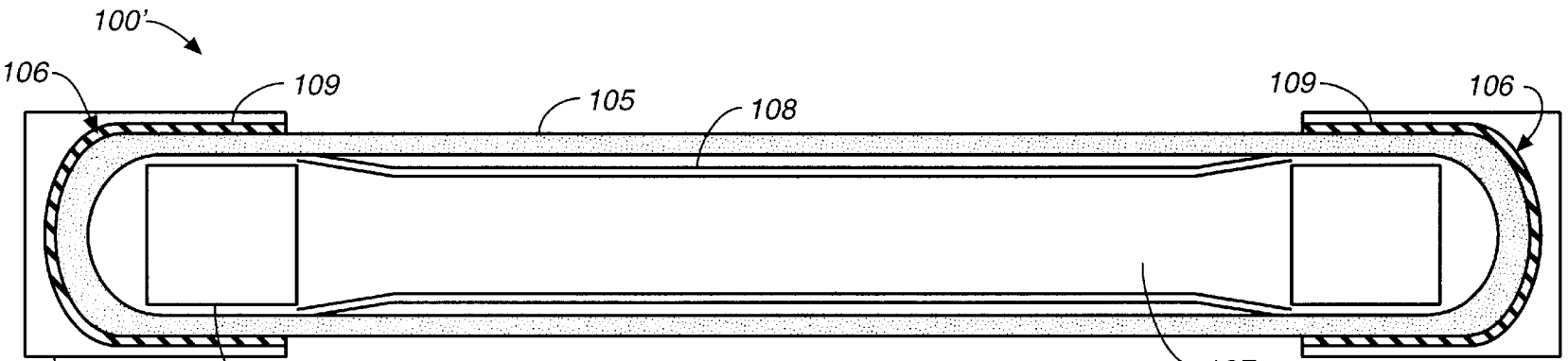
FIG. 12 is a cross-sectional view of the CCFL with no electrodes inside the sealed envelope to illustrate one embodiment of the invention.

FIG. 11 is a cross-sectional view of a conventional CCFL similar in design to that shown in FIG. 1. As noted above, when a large current is passed between nodes 4*a*, 4*b*, such as a current in excess of 5 milliamps., sputtering of electrodes 3 drastically reduces the useful life of the device 100. Furthermore, mercury in tube or envelope 1 may combine with the sputtered material from electrodes 3 to form a deposit on the inside surface of envelope 1, thereby depleting the amount of mercury available for generating the gas discharge in the tube. When the amount of mercury falls below a certain level, the CCFL lamp 100 becomes defective and must be discarded. One aspect of the invention is based on the observation that the necessary electric field for operating a CCFL may be applied from electrically conductive members outside the tube or envelope so that the above-described problems are altogether avoided. This is illustrated in FIG. 12. As shown in FIG. 12, device 100' comprises a tube or envelope 105 made of a hard or soft glass or quartz, containing a medium 107 that includes a discharge material such as mercury, xenon and one or more inert gasses such as argon, helium, neon or other inert gasses. The tube 105 is vacuum-sealed and contains no electrode inside. Therefore, envelope or tube 105 is much easier and less expensive to make than tube 1 and enables a higher yield in production. Using hard glass or quartz for envelope 105 is particularly advantageous in view of manufacturing considerations.

As shown in FIG. 12, tube or envelope 105 is elongated with two ends 106. Two electrically conductive members comprising two layers 109 are formed on the outside surfaces of the two ends of tube 105, where layer 109 may be made of a silver paste, graphite or other metallic or non-metallic electrically conductive material. Electrically conductive layer 109 may be connected to a driver (not shown) preferably through metallic caps 110. The inside surfaces of tube 105 at the two ends 106 are coated by a protective layer 111 made of a material such as magnesium oxide (MgO), to improve the efficiency in generating secondary electrons, and to reduce the cathode-fall voltage. When suitable power, such as AC power in the range of 10–100 kHz and 100 volts to 50 kilovolts is applied across layers 109, an electric field is applied to the medium 107 in the tube, causing the gas discharge in the medium to generate light for illumination. As noted above, the ultraviolet light so generated would cause the optional fluorescent layer 108 to generate visible light. The AC power applied is coupled to the medium 107 by means of electrically conductive layers 109 through the capacitance between the two layers 109. The value of the capacitance is determined by the areas of layers 109, the thickness and material of tube 105 and the gaseous medium 107. By choosing the appropriate materials and dimensions, it is possible to achieve an appropriate capacitance in order to apply the AC power to the gaseous medium 107 to cause gas discharge. Where it is desirable for device 100' to generate ultraviolet light instead, phosphor layer 108 may be omitted.

Figure 13:
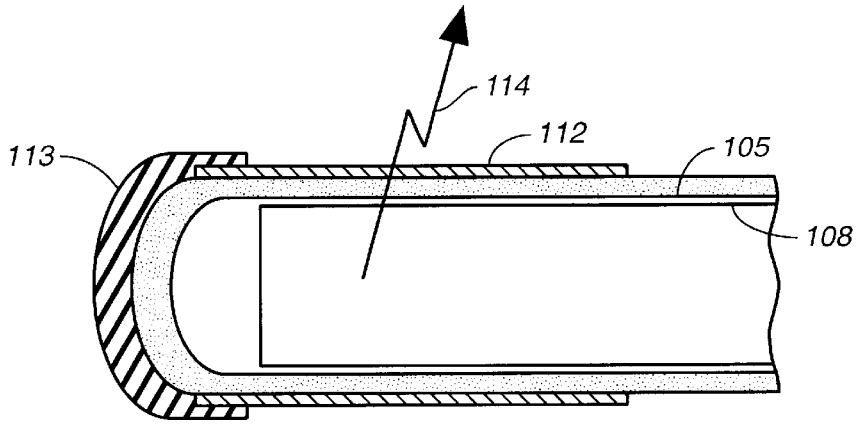
FIG. 13 is a cross-sectional view of one end of a CCFL with a transparent electrically conductive layer to illustrate one embodiment of the invention.

FIG. 13 is a cross-sectional view of one end of a CCFL with a transparent electrically conductive layer, such as one made of tin oxide or indium tin oxide 112, to illustrate another embodiment of the invention. When electrically conductive layer 112 is transparent, the light generated in the zone of tube 105 enclosed by the layer 112, such as light 114, will also pass through layer 112 and contribute to illumination.

Figure 14:
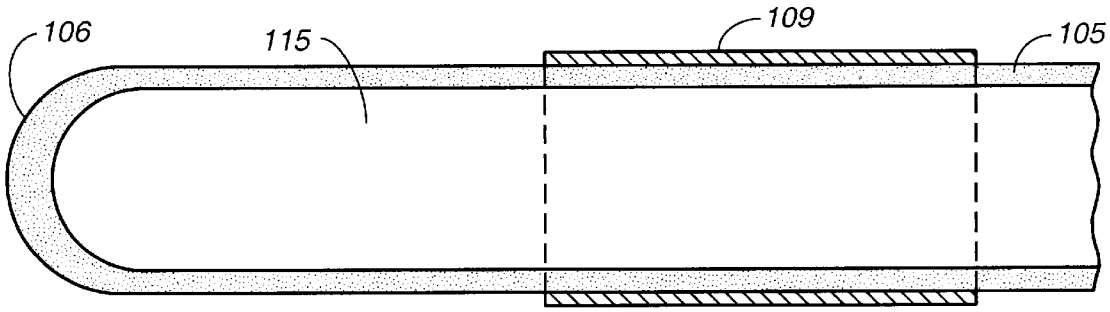
FIG. 14 is a cross-sectional view of a section of a CCFL with a cold end to illustrate another embodiment of the invention.

In order to assist heat dissipation and reduce the temperature of the gaseous medium, it is possible to place the electrically conductive layer 109 not at the end 106 of tube 105 but at an intermediate position away from end 106 as shown in FIG. 14. In such configuration, no significant electric field is present in section 115 near one of the ends 106 of tube 105, so that no gas discharge will occur in such section which becomes a cold end of the CCFL. This cold end is effective in reducing the temperature of the gaseous medium and increases the useful life of the CCFL.

Figure 15:
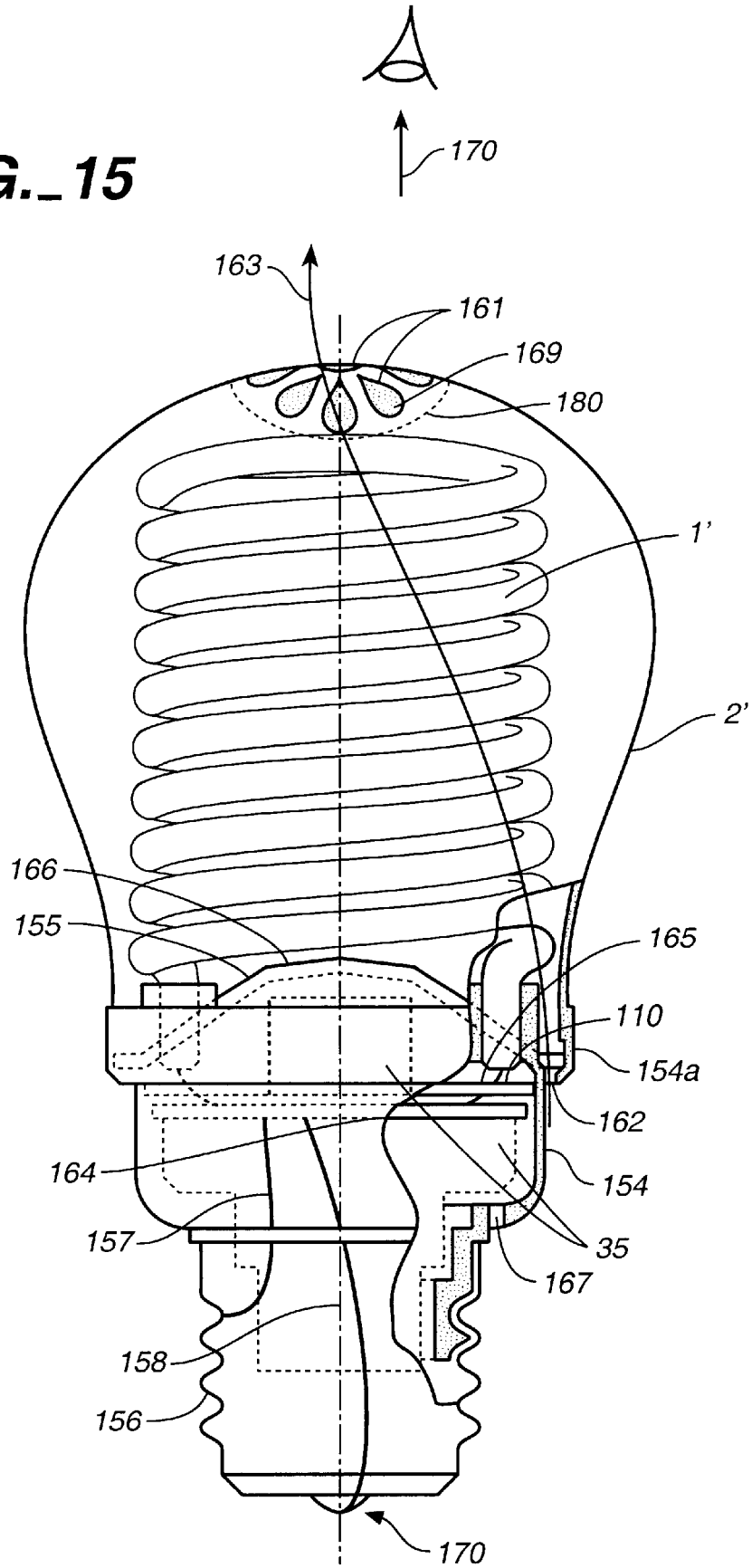
FIG. 15 is a side view with a portion cut away of a CCFL device with a container for housing the CCFL, a housing for housing the driver with respective holes in the housing and container for achieving more efficient heat dissipation to illustrate another embodiment of the invention.

Another problem in using the CCFL for high power applications is heat dissipation. FIG. 15 is a side elevational view with a portion cut away of a CCFL device with a container for housing the CCFL and a housing for housing the driver. Both the container and the housing have a hole to enhance heat dissipation. The two holes in the container and the housing allow air circulation in the chamber formed by the container and the housing in which the CCFL is situated, to effectively carry away the heat generated by the CCFL so that the temperature of the CCFL will not be excessive. As shown in FIG. 15, the improved CCFL device includes a CCFL tube or envelope 1' in the shape of a spiral. CCFL 1' is contained in the chamber formed by a transparent or light diffusive container 2' made of glass or plastic. A driver 35 applies the appropriate power to the CCFL tube 1' for generated light. Driver 35 is contained in the housing 154 which is connected to container 2' to form a chamber for holding the CCFL 1'. Part **154*a* is the top portion of housing 154. Driver 35 is electrically connected to an electrical connector 156 of a conventional type usually seen on incandescent lamps by means of wires 157 and 158. Electrical connector 156 is connected to a power source (not shown) in the same manner as is done conventionally for incandescent lamps. Driver 35 is electrically connected to CCFL 1' by wires 109 and 110. Therefore, when appropriate power is applied to connector 156, driver 35 will apply the appropriate power to CCFL 1'** causing gas discharge in the CCFL in order to generate light.

Container 2' has or defines holes 161 therein. Preferably the holes are located at the top end of container 2' so that the holes are not noticeable when the CCFL device is viewed from the side. The top portion **154*a* of housing 154 has at least one hole 162 therein. Preferably holes 161 and 162 are in communication with the chamber formed by the container 2' and housing 154 so that air circulation 163 is possible through the holes 161, 162 and through the chamber, in order to efficiently dissipate the heat generated by the CCFL tube 1'**.

In order to shield the driver 35 from the high temperature of CCFL 1', a heat insulative layer or plate 165 is employed, to shield the printed circuit board 164 in driver 35 from the high temperature of the CCFL.

A light reflective layer 166, such as one made of aluminum may be employed on top of the top portion **154*a* of the housing to reflect visible and infrared light, thereby improving the efficiency of the CCFL device and to reduce the temperature of the driver 35. Another hole 167 may be provided in housing 154 at a location close to connector 156, to enable the heat generated by the driver 35 to be effectively dissipated by means of air circulation through holes 167 and 162**.

The design in FIG. 15 is advantageous in that it resembles the appearance of the commonly used incandescent lamps which has wide consumer acceptance and is familiar to the public. The holes 161, 162, 167 are provided at locations that are not conspicuous to the user, while at the same time are effective in enabling air circulation through the chamber holding the CCFL and the driver for effective heat dissipation. This design enables a high power CCFL device to be constructed for delivering high intensity illumination. It is aesthetically pleasing and has high efficiency, long useful life and can be made in different sizes for different consumer and commercial applications.

The holes 161 can be in the shape of chrysanthemum, as shown in FIG. 15, or can take the shape of a company's trademark or company name. Since holes 161 are of sizes that insects may enter the container 2', on the inside surface of the container 2' is attached a thin wire mesh 169 (shown as area 180 in dotted line in FIG. 15) to cover holes 161; this mesh may be made of a material with small holes (e.g. nylon mesh, metal mesh). This prevents small insects from entering into the bulb 2'. This thin wire mesh can also be attached to the inside surface of hole 162 (not show).

Figure 16:
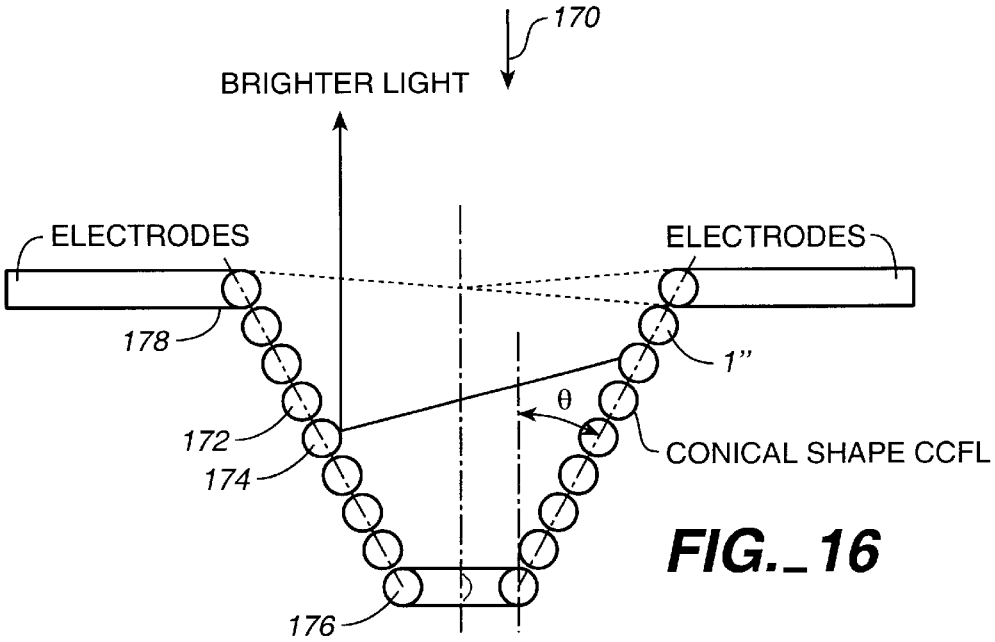
FIG. 16 is a cross-sectional view of a CCFL with a conical spiral shape connected to two electrodes to illustrate yet another embodiment of the invention.

FIG. 16 is a cross-sectional view of a CCFL 1" to illustrate yet another embodiment of the invention. As will be noted from the spiral shape of the CCFL 1' of FIG. 15, such shape of the CCFL enables a long CCFL tube to be employed to increase the light intensity generated. However, depending on the direction of viewing, at least some of the light generated by rounds of the spiral in the middle portion may be blocked by other rounds at the two ends of the spiral, at least when the CCFL device is viewed from the top, along direction 170 in FIG. 15. This may not be desirable for applications such as traffic lights, where it is desirable to direct the light generated towards a particular general direction. FIG. 16 illustrates a cross-sectional view of a CCFL tube 1" in the shape of a conical spiral. The generally spiral shape of the tube 1" enables a long CCFL tube to be employed to increase the light intensity generated. At the same time, since the spiral is conical in shape, the intermediate rounds 172, 174 will not be blocked by the rounds or coils 176, 178 at the two ends of the spiral. In fact, much of the light generated by each individual coil or round in the conical spiral is not substantially blocked by the other rounds of coils in the spiral when viewed from the viewing direction 170. This is particularly useful for directional illumination, such as for traffic lights.

While preferably, tube 1" is in the shape of a conical spiral, this is not required as long as the different rounds in the spiral do not all have the same diameter so that the light generated by at least some of the rounds of coils will not be blocked by other rounds of coils of the spiral; such and other variations are within the scope of the invention. As also indicated in FIG. 16, the shape of the conical spiral can vary depending on the cone angle θ, which preferably is in the range 5–80°. Where the shape of tube 1" is not strictly a conical spiral, but takes on the general shape of a conical spiral, an approximate cone angle can still be defined and can vary widely as shown in the range of θ above. The above-described shapes of the CCFL may be employed with any of the embodiments of this application.

Figure 17:
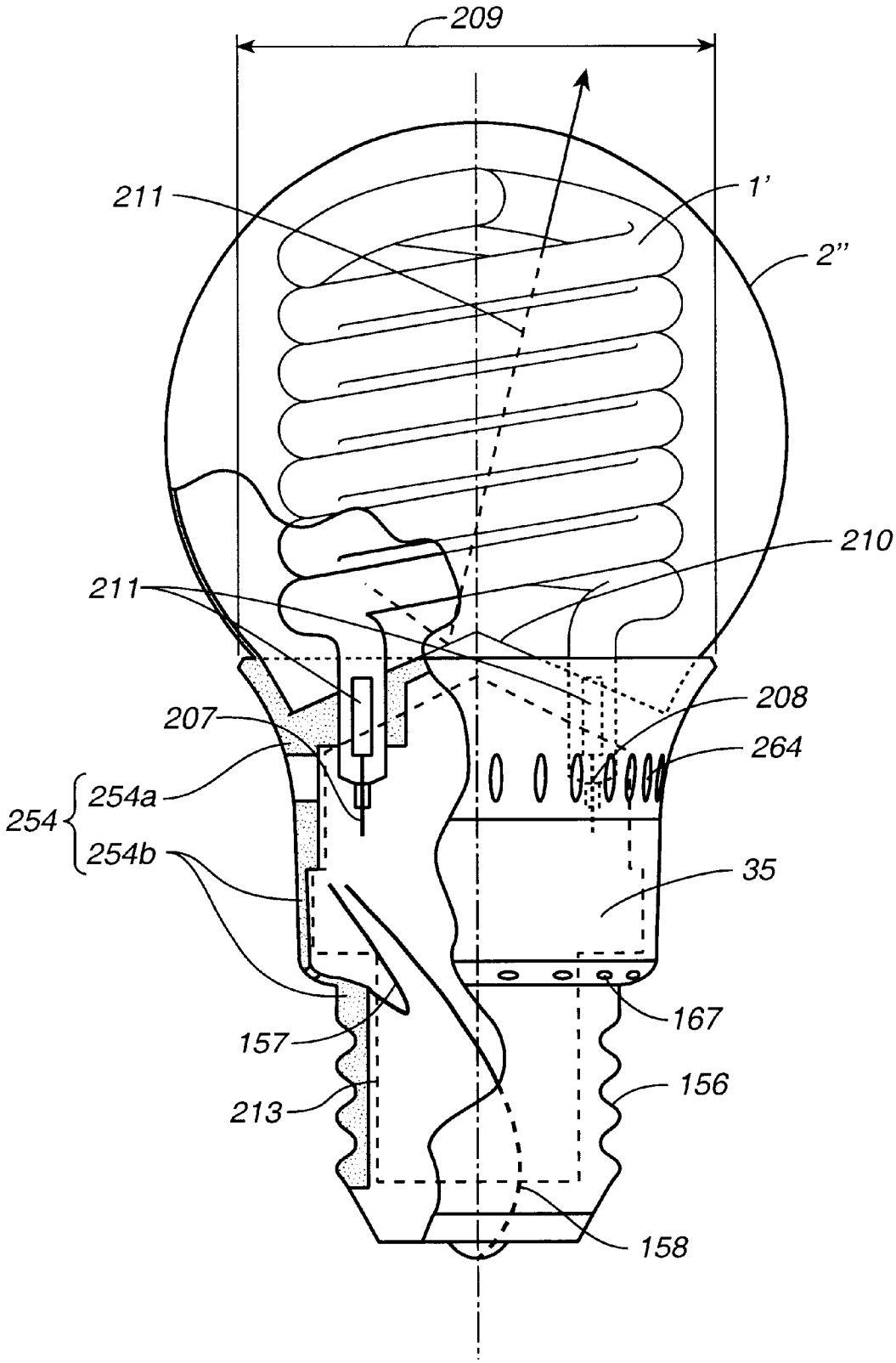
FIG. 17 is a side elevational view fo a CCFL device with a portion cut away to illustrate a CCFL device where the end of the housing for the driver adjacent to the container for the CCFL is larger than other parts of the housing to illustrate another embodiment of the invention.

FIG. 17 is a side elevational view of a CCFL device with a portion cut away to illustrate a device where the end of the housing for the driver adjacent to the container is larger than the other portion to illustrate another embodiment of the invention. For high power CCFL applications, it will be desirable to employ a longer and/or larger CCFL in order to delivery high intensity illumination. For this reason, it will be desirable for the container containing the CCFL tube to be of a larger size so that it can accommodate a longer and/or larger CCFL tube. In order to accommodate the use of a longer and/or larger CCFL tube, the housing for the driver is preferably designed such that the portion of the housing adjacent to the container is larger so that it can be connected smoothly to the container to form a chamber for housing the CCFL tube, while the remaining portion of the housing may be smaller for connection to the electrical connector. Furthermore, by enlarging the portion of the driver housing adjacent to the container, it is possible to allow space to move the ends of the CCFL tube containing electrodes into the housing for the driver, thereby enabling more efficient heat dissipation. Furthermore, this design enables more efficient use of space within the container/housing combination. Thus, for a given height of the combination, more space will be available for the driver, so that a higher efficiency driver can be employed.

Thus as shown in FIG. 17, the housing 254 for the driver 35 has two portions: an upper portion 254*a* which has a larger upper end for connection to container 2" for the CCFL 1' and a lower smaller portion 254*b* for connection to connector 156. Since the upper portion 254*a* has a larger upper end, it can accommodate a larger sized container 2" and therefore, a longer and/or larger CCFL 1' for generating illumination of high intensity. Thus, the diameter 209 of the upper end of portion 254*a* is larger than the diameter of the lower portion 254*b*. Furthermore, the two ends of CCFL tube 1' and electrodes 212 contained by the ends protrude beyond the container 2" into housing 254. Since much heat will be generated at the electrodes 212 during lamp operation, such design enables the two ends of the CCFL at high temperature to be shielded from the remaining portion of the CCFL tube and the chamber within container 2" to lower the overall temperature and to increase its useful life. A number of holes 264 are provided in the upper portion 254*a* of the housing in order to dissipate the heat generated at the electrodes 212 and by driver 35. As in the prior embodiment, holes 167 may be provided in the lower portion of housing 254 adjacent to the connector 156 for more efficient heat dissipation. For more efficient use of space, a portion of the driver 35 extends into connector 156 as shown by dotted line 213. Given an overall height of the device, a larger and a higher power driver may be employed and enclosed within the available space.

As shown in FIG. 17, electrodes 212 are connected to driver 35 by wires 207, 208. When appropriate power is applied by power source (not shown) to connector 156, wires 157, 158 will apply the power to driver 35 which, in turn, applies an appropriate power to electrodes 212 for generating light. Preferably, a reflective layer 210 is employed on the top portion 254*a* of the housing in order to reflect light generated by the tube 1', as shown by dotted lines 211.

Container 2" may be transparent or may be light diffusive. It may be made to filter out certain components of the light generated, have certain designs thereon or have lens or prisms as shown more clearly in FIG. 18, which shows a variation of the embodiment of FIG. 17. Portions of the container 2" may be light reflective. The shape of container 2" may be spherical, pear-shaped, cylindrical, mushroom-shaped or in the shape of a candle flame. The shape of housing 254 may be other than as shown, such as cylindrical. Heat generated by the driver 35 may be dissipated by means of air circulation through holes 167 and 264. Driver 35 is shielded from electrodes 212 by means of housing portion 254*a*.

Figure 18:
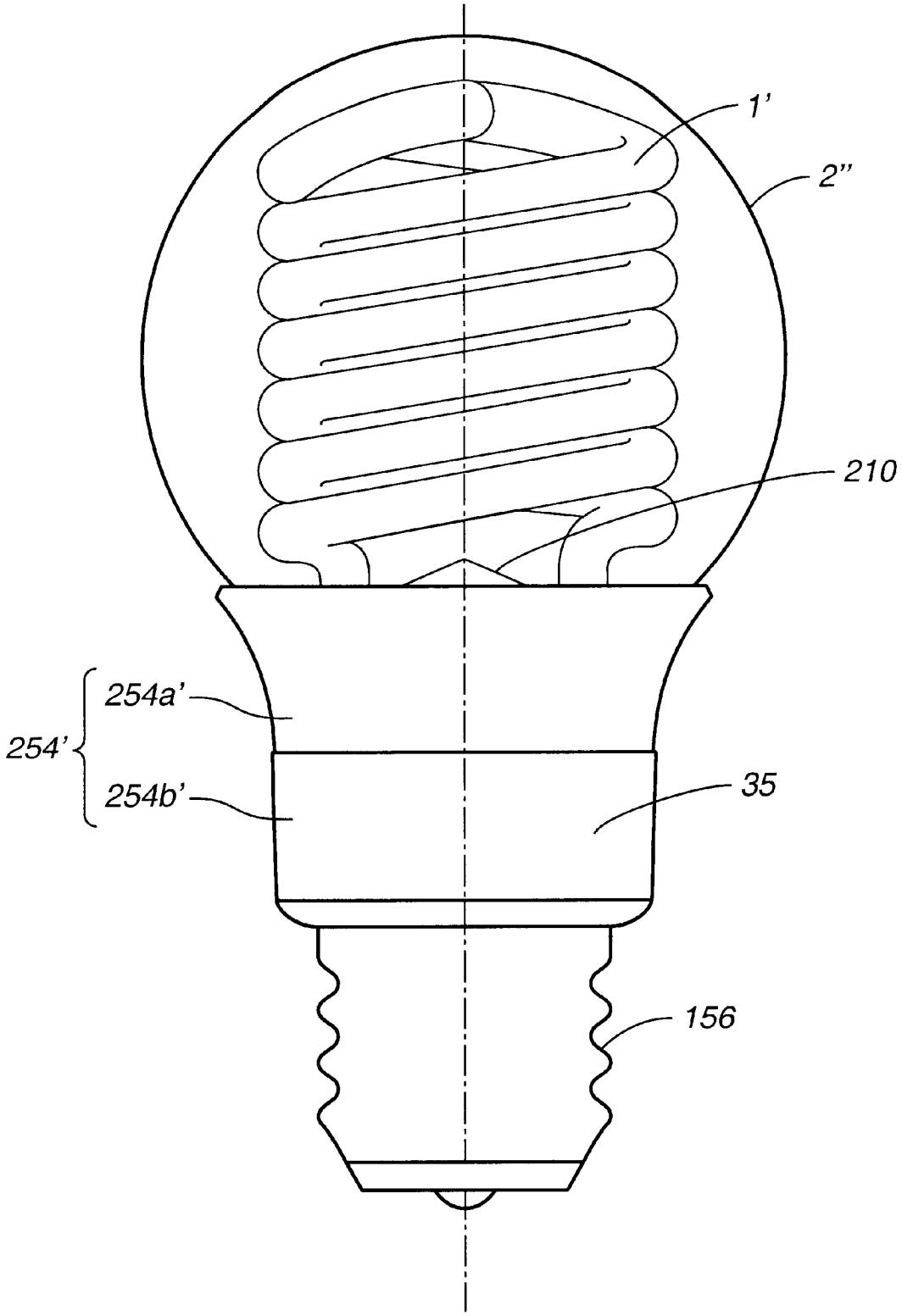
FIG. 18 is a side elevational view of a CCFL device which is a variation of that shown in FIG. 17.

FIG. 18 illustrates a variation of the embodiment of FIG. 17; the main difference between the embodiments of FIGS. 17 and 18 is that the housing 254' of the embodiment in FIG. 18 is not provided with through holes therein. The embodiment of FIG. 18 is more suitable for outdoor applications.

Figure 19:
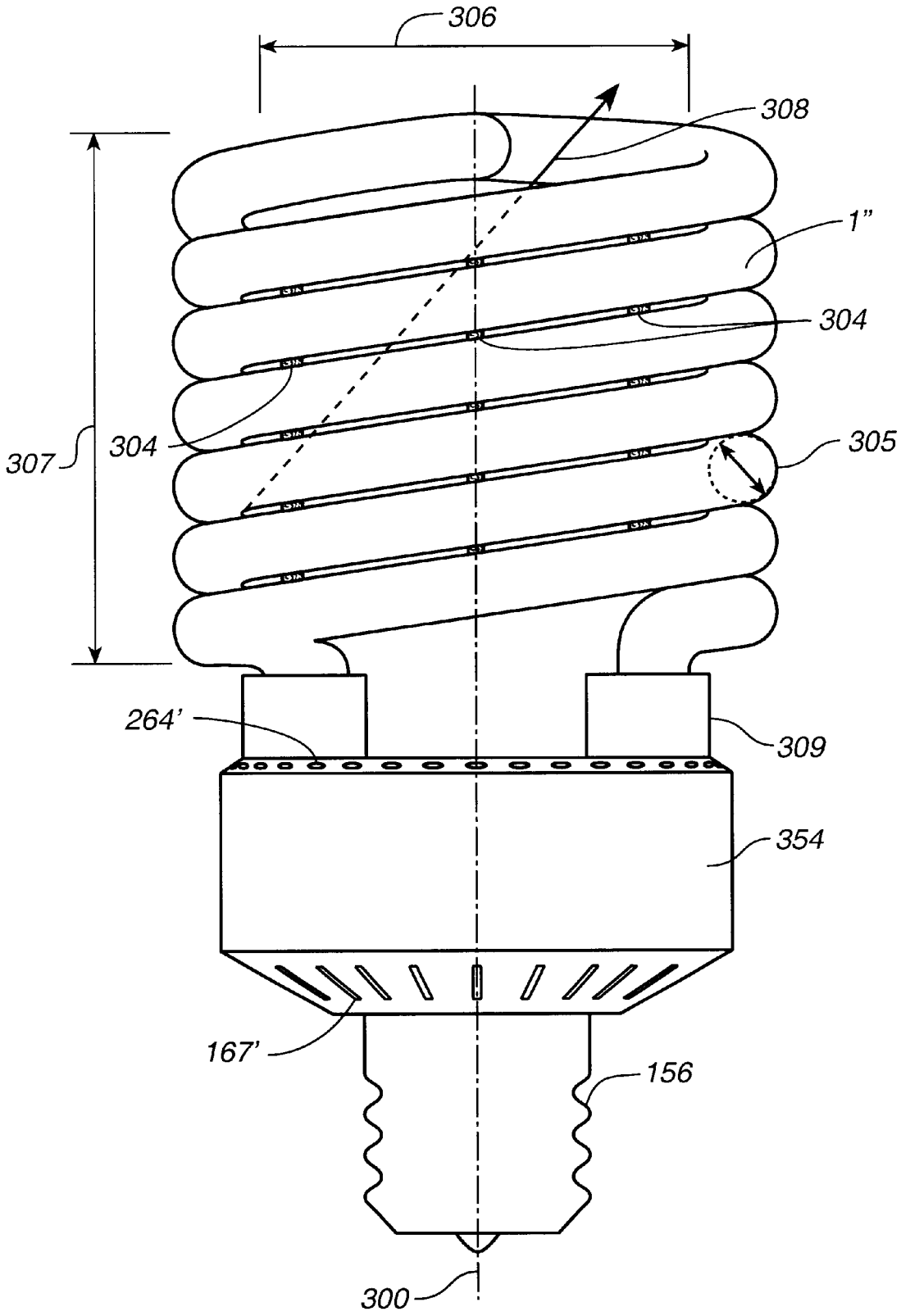
FIG. 19 is a side elevational view of a CCFL device where the spiral CCFL is not contained in any container but at least two rounds of the spiral CCFL are attached together to provide mechanical strength, illustrating yet one more embodiment of the invention.

Due to the operating principles of the CCFL, the best internal diameter of the sealed envelope of a CCFL is about 2 mm with its outside diameter in the range of 3 to 3.5 mm. For this reason, conventional CCFL tubes or envelopes do not have adequate mechanical strength for everyday use. Thus, to lend mechanical strength for easy handling, the CCFL is enclosed within a container to protect the CCFL sealed envelope or tube. However, the use of the container impedes heat dissipation, especially for high power applications where high intensity illumination is desirable. According to another aspect of the invention, the mechanical strength of the CCFL envelope is enhanced by attaching at least two adjacent rounds or coils of a spiral-shaped CCFL tube or envelope together so that it is less prone to breakage. Preferably, all adjacent coils or rounds of the spiral-shaped CCFL tube are attached together to increase the mechanical strength of the overall CCFL device. Thus, between two adjacent rounds of the CCFL tube, there is at least one location where the two coils are attached; preferably, between two adjacent coils of the CCFL tube, the two coils are attached at three or more different locations. This embodiment is illustrated in FIG. 19. Thus as shown in FIG. 19, the CCFL tube or envelope 1' is not enclosed within any container. Instead, adjacent rounds or coils of the spiral-shaped CCFL tube are connected together by an adhesive material 304. Preferably, every two pairs of adjacent coils or rounds of the spiral-shaped tube are connected together at three or more different locations as illustrated in FIG. 19 to lend mechanical strength to the resulting structure, it being understood that this is not required and that as long as there is at least one pair of adjacent coils that are attached to at least one location, the mechanical strength of the structure is improved. While preferably, the coils are attached together by an adhesive material, other mechanisms for attaching adjacent coils may be used and are within the scope of the invention, such as by using plastic or metal binders that wrap around two or more adjacent coils or rounds of the tube. Such binders may be used in lieu of, or in conjunction with, the adhesive material 304. The adhesive material 304 may be a epoxy, resin or silica gel or other type of adhesive.

A driver contained within housing 354 is connected electrically to electrical connector 156 and the two ends of CCFL tube 1'. Housing 354 has two protruding portions 309 which form sockets into which the two ends of 1' may be inserted to enhance the mechanical strength of the connection between tube 1' and housing 354. In order to attache adjacent coils of the spiral-shaped tube 1', the gap between adjacent rounds is preferably small so that the overall height 307 of tube 1' will be smaller, thereby increasing the light intensity in a direction perpendicular to the axis 300. Since the outside diameter 305 of a CCFL tube such as 1' is usually smaller than that of hot cathode fluorescent lamps, such as less than 10 mm, for the given overall dimensions of the lamp in a plane perpendicular to axis 300, the inside diameter 306 can be larger, such as larger than 20 mm. Therefore, for a given length of the tube 1', the overall height 307 can be smaller, thereby increasing the light intensity generated in directions perpendicular to axis 300.

As before, when an appropriate electrical power is applied to connector 156 which is connected to the driver in housing 354, the driver applies an appropriate power to CCFL tube 1', causing gas discharge therein and light emission.

Figure 20:
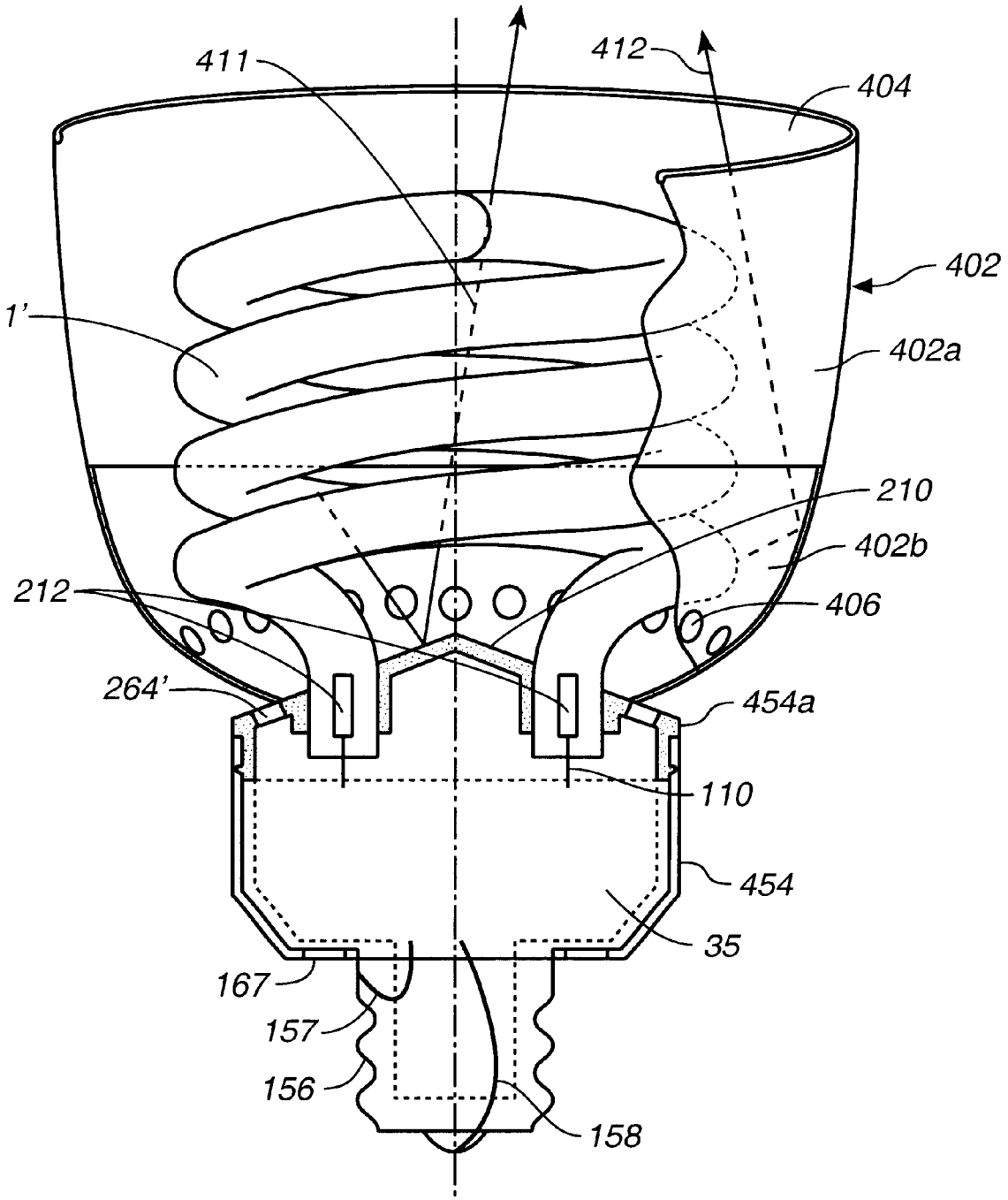
FIG. 20 is a partially side elevational view with a portion cut away and partially cross-sectional view of a CCFL device where the container for containing the CCFL is open-ended at one end for improved heat dissipation, illustrating one more embodiment of the invention.

Instead of dispensing with the container altogether as in the previous embodiment in FIG. 19, another solution is to employ a container which is open at one end to allow more effective heat dissipation as illustrated in FIG. 20. Holes 167, 264' permit more effective heat dissipation from the ends of tube 1' and from the driver. As before, the reflective layer 210 improves the efficiency of light generation in the device and alleviates the heating of the driver caused by visible and infrared light from tube 1'. The light generated by tube 1' is illustrated by arrow 411, 412.

As in the previous embodiment, the two ends of tube 1' and the electrode 212 enclosed extend into the top portion 454*a* of housing 454 for driver 35. Heat generated by electrodes 212 and driver 35 is dissipated through holes 264' and 167 of housing 454. A portion of driver 35 extends into connector 156. When power is applied to connector 156, such power is connected to driver 35 through wires 157, 158 and driver 35 applies appropriate power to electrodes 212 causing gas discharge and light emission from tube 1'. Container 402 containing tube 1' has an open end 404 which is relatively large and effective in allowing heat dissipation from tube 1'. Container 402 comprises a top portion 402*a* which may be transparent or light diffusive and another portion 402*b* which has a reflective surface so that light generated by tube 1' may be reflected as illustrated by arrow 412. The top portion 454*a* of the housing has a reflective surface 210 thereon which also reflects light generated by tube 1' as shown by arrow 411.

Figure 21:
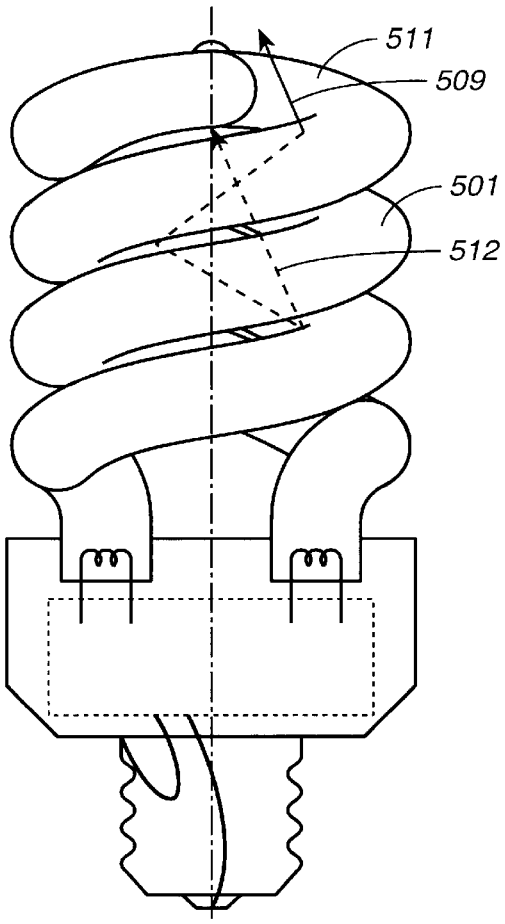
FIG. 21 (PRIOR ART)
FIG. 21 is a partially side elevational view and partially cross-sectional view of a hot cathode fluorescent lamp device.
Figure 22:
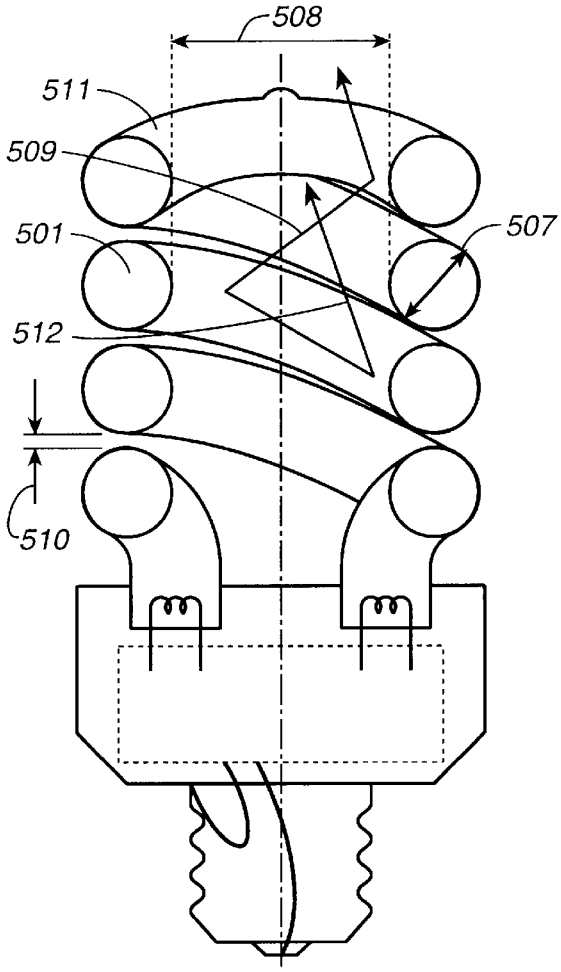
FIG. 22 (PRIOR ART)
FIG. 22 is a cross-sectional view of the hot cathode device of FIG. 21.

FIGS. 21 and 22 are, respectively, side elevational and cross-sectional views of a hot cathode fluorescent lamp. Due to its operational principles, the diameter of tube 501 of a hot cathode fluorescent lamp is typically large, such as about 12 mm. For this reason, the inside diameter 508 of the spiral is typically small and the gap 510 between adjacent coils is also small, so that light generated from the inside surface of the coil may need to undergo multiple reflections such as 512 which is blocked by a top portion 511 of the tube; only some rays can be emitted without additional reflections for illumination purposes, such as shown in arrows 509.

Figure 23B:
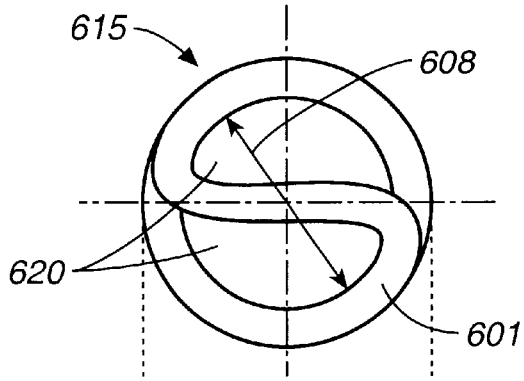
FIG. 23B is a view top of the CCFL device in FIG. 23A.
Figure 23A:
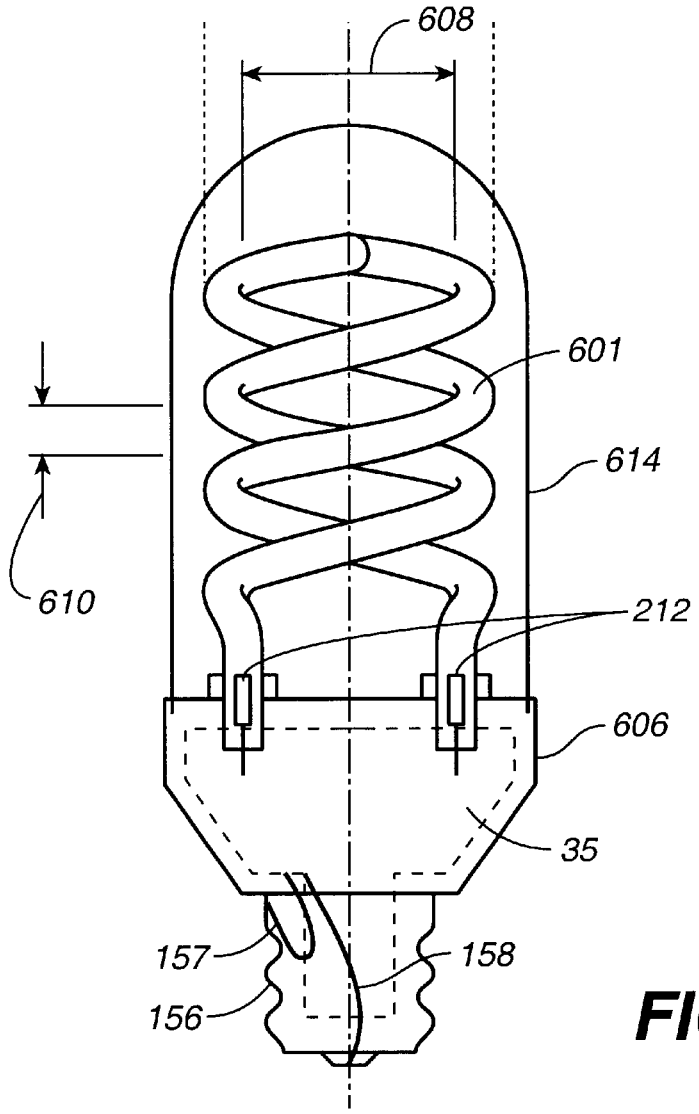
FIG. 23A is a partially side elevational view and partially schematic view of a CCFL device that employs a spiral CCFL of larger diameter and a larger gap between rounds of the spiral to illustrate another embodiment of the invention.

FIG. 23A illustrates a CCFL having light emission characteristics which are better than those of the hot cathode fluorescent lamps of FIGS. 21 and 22. CCFL envelope 601 employs thin walls, such as in the range of 0.2 to 0.7 mm with an outside diameter of 1.6 to 10 mm. The tube 601 is spiral-shaped. Since tube 601 has a small diameter, given the same amount of space as occupied by the hot cathode fluorescent lamp in FIGS. 21 and 22, the gap 610 between adjacent coils can be larger. The internal diameter 608 of the spiral can also be larger to provide a larger light emission window compared to the hot cathode fluorescent lamp. For example, and as shown in FIG. 23B which is a top view of the device in FIG. 23A, the area or window 620 of light emission is larger than 50% of the area (of diameter 608 in FIG. 23A) enclosed by the spiral.

Figure 24:
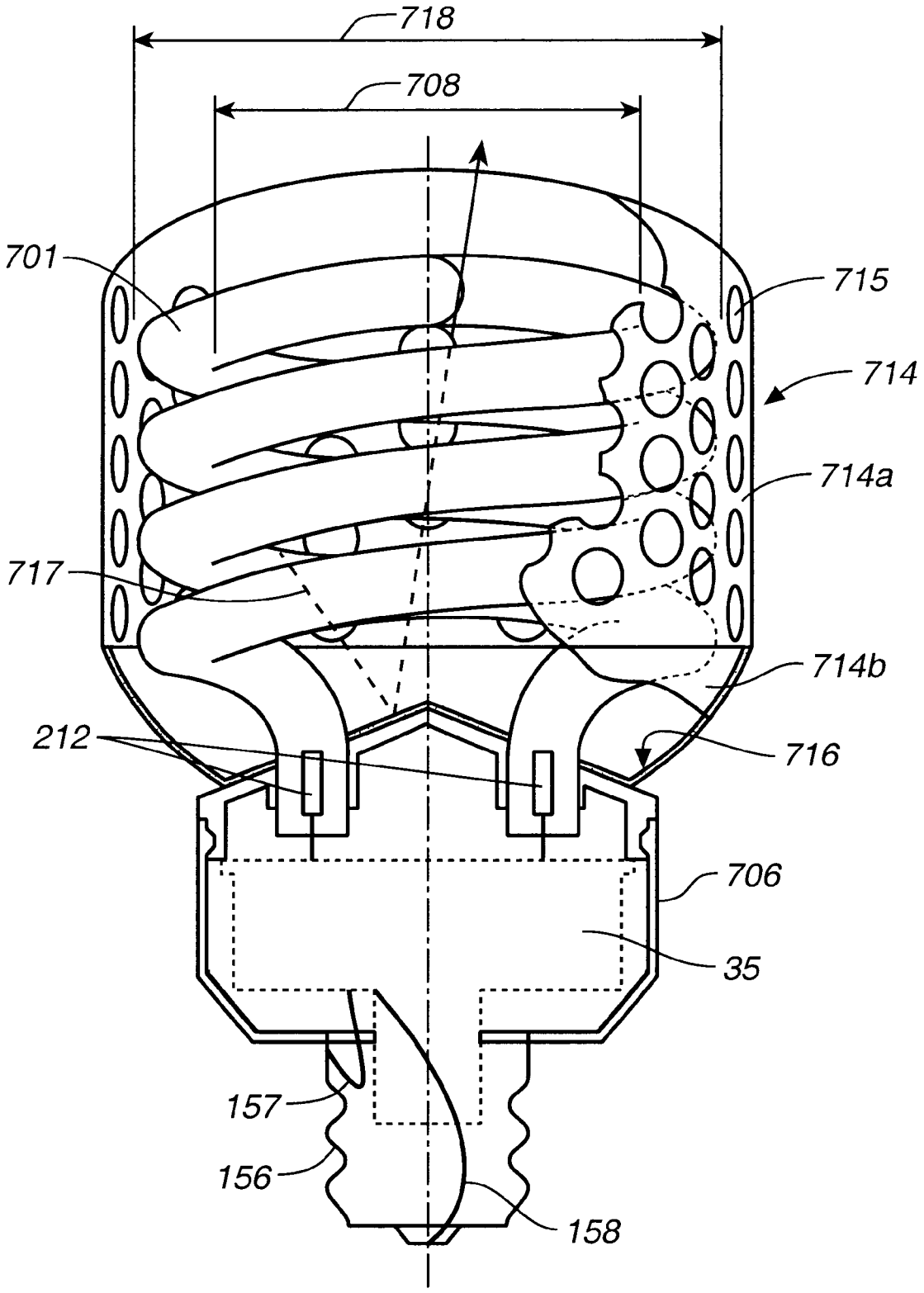
FIG. 24 is a partially elevational view with a portion cut away and partially schematic view of a CCFL device employing the spiral CCFL of FIG. 23A and a container for the CCFL with holes therein to illustrate another embodiment of the invention.

FIG. 24 is a partially elevational view with a portion cut away and partially schematic view of a CCFL device to illustrate another embodiment of the invention. The embodiment of FIG. 24 is similar to FIG. 23A except that the container 714 defines holes therein for more effective heat dissipation whereas container 614 has no holes therein. Container 714 may comprise an upper portion 714*a* made of a transparent or light diffusive material and a lower portion 714*b* made of a heat conductive material such as metal (e.g. aluminum) or heat conductive plastic, ceramic or glass. The upper portion 714*a* is larger than the lower portion 714*b* to enable a spiral-shaped CCFL 701 of larger spiral diameter to be used with a larger light emitting window 708 and also enables a longer CCFL tube 701 to be used. The lower portion 714*b* may be provided with a reflective layer 716 on its inside surface to reflect light generated by the tube. The top portion of housing 706 has a reflective layer to reflect light generated by the coil as shown by arrow 717.

Figure 25:
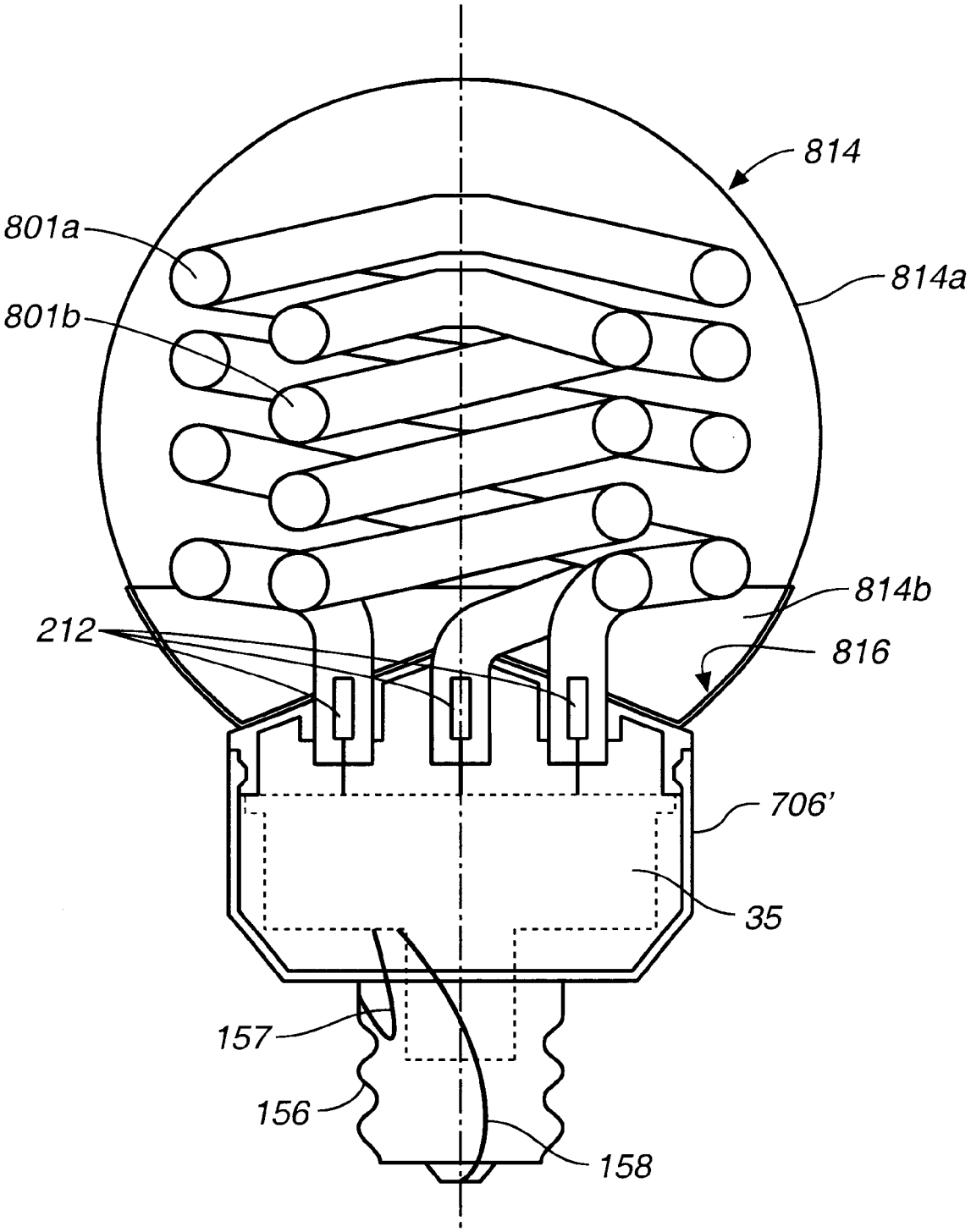
FIG. 25 is a partly cross-sectional and partly schematic view of a CCFL device employing two CCFLs to illustrate yet another embodiment of the invention.

FIG. 25 is a cross-sectional view of a CCFL device to illustrate another embodiment of the invention. The main difference between the embodiments of FIGS. 25 and 24 is that in the embodiment of FIG. 25, more than one CCFL tube (801*a*, 801*b*) are employed instead of the single CCFL 701 in FIG. 24, and the different shapes of the containers 714, 814. Another difference is in that in CCFLs 801*a*, 801*b*, the gap between the adjacent coils varies and is not constant. Thus, the gap between the adjacent coils is larger at locations closer to the driver as opposed to the gap between coils at a larger distance from the driver; this enables more even temperature within the gaseous medium enclosed within container 814 and increases the efficiency of the CCFLs.

While not specifically described, it will be understood that many of the features in the different embodiments may be used separately or in conjunction. Thus, the conical spiral-shaped CCFL tube may be employed in any one of the above-described embodiments. Similarly, each of the embodiments may employ more than one CCFL tube or envelope where the two or more tubes or envelopes may generate light of the same or different colors. The CCFL devices may be used for illumination, traffic lights or display devices for displaying information of different types. All such variations are within the scope of the invention.

Figure 26:
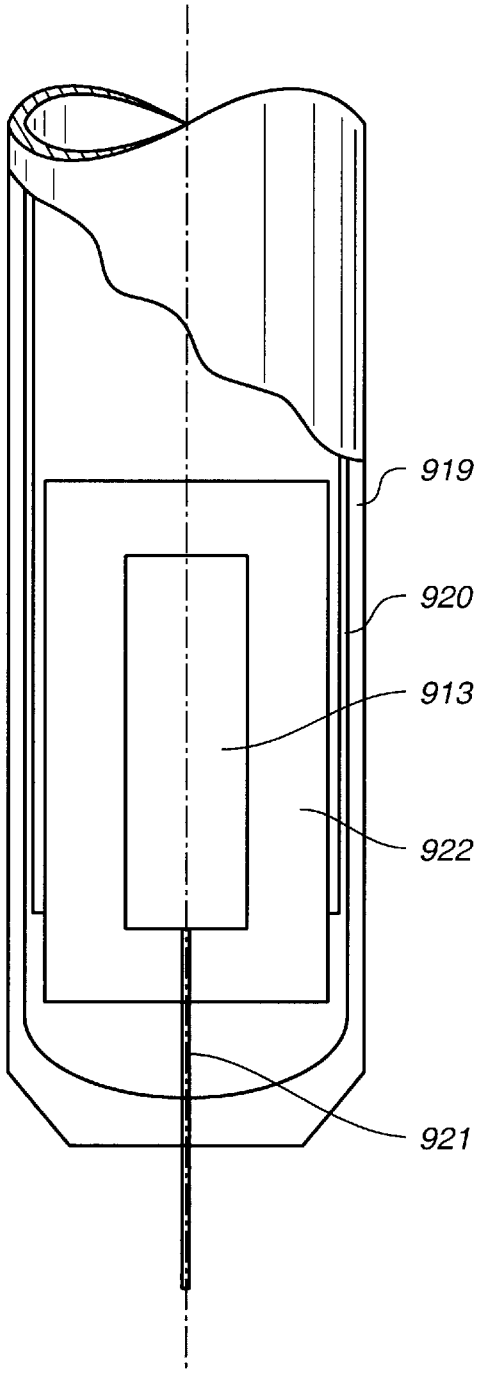
FIG. 26 (PRIOR ART)
FIG. 26 is a cut away view of a portion of a CCFL envelope showing an electrode in a convention design.
Figure 27:
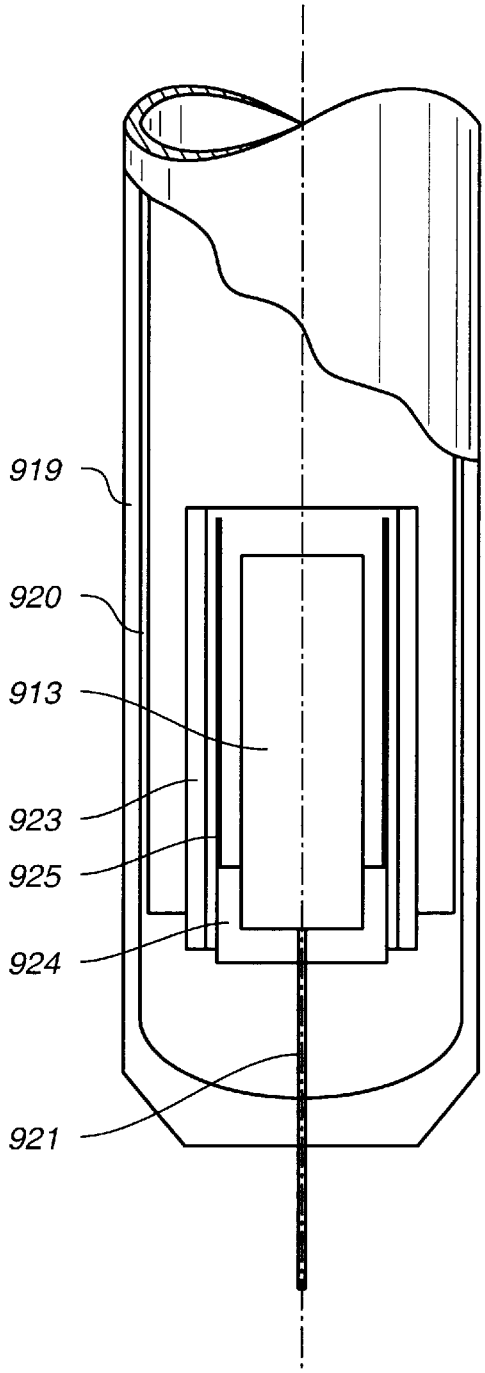
FIG. 27 is a cut away view of a portion of a CCFL envelope where the electrode is enclosed by an electrode holder to show one more embodiment of the invention.

FIG. 26 is a cut away view of a portion of a conventional CCFL tube or envelope. As shown in FIG. 26, the CCFL device has an envelope or tube with a protective and fluorescent layer 920 on its inner wall. The cold cathode 913 is in the shape of a plate or a cylinder and is connected through wire 921 which passes through envelope 919 to an outside circuit. During its operation, sputtering occurs at cathode 913 which, as described above, may consume the mercury enclosed in envelope 919. When the amount of mercury present in the envelope is inadequate to sustain a gas discharge, the conventional CCFL device in FIG. 26 will need to be discarded. Another aspect of the invention as shown in FIG. 27, which overcomes such defect of the conventional CCFL by enclosing the cathode 913 within a holder 923, preferably made of a metal material such as a thin layer of nickle. Preferably, an electrically and thermally insulating material 924 insulates thermally the holder 923 from cathode 913; this insulating material 924 may include glass or a ceramic material which attaches holder 923 to the cathode. More of the mercury alloy resulting from the sputtering of cathode 913 will then be deposited on the inside surface of holder 923 than on wall of envelope 919. Since holder 923 is close to cathode 913 at a high temperature and has a small heat capacity, its temperature will be higher than that of tube or envelope 919 so that the mercury alloy deposited thereon will decompose under the influence of high temperature, so that mercury in the alloy will be released. This reduces mercury consumption caused by the sputtering and lengthens the useful life of the CCFL device.

Figure 28:
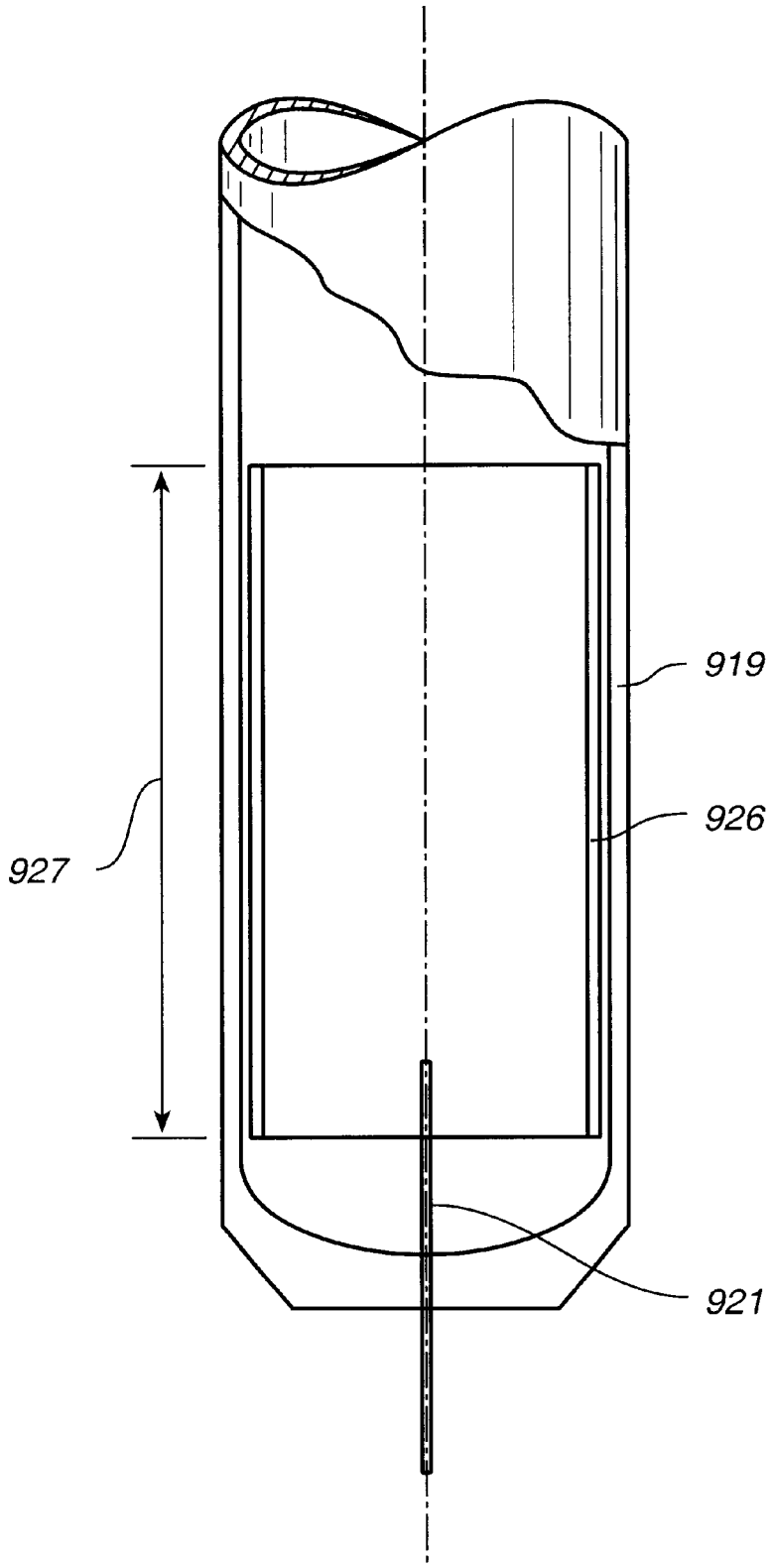
FIG. 28 is a cut away view of a portion of a CCFL envelope with a large area cathode to illustrate another embodiment of the invention.

FIG. 28 shows another embodiment for a structure of an electrode that can withstand larger currents. The electrode 926 is a cylinder shaped electrode and is preferably made of a metal foil, e.g. Ni, Fe, Ta or alloy etc. The diameter of the electrode is as large as possible so as to obtain a maximum electrode surface area. For example, the electrode can be so large that it is in contact with the glass tube 919. The height or length 927 of the electrode is larger than 10 mm, also to increase the electrode surface area. A larger surface area for the electrode enables the ions returning to the electrode to be spread over a larger area, and therefore reducing the amount of sputtering experienced per unit area of the electrode. By designing the electrode so that it is in contact with the tube wall 919 also allows heat to be dissipated more effectively.

Figure 29:
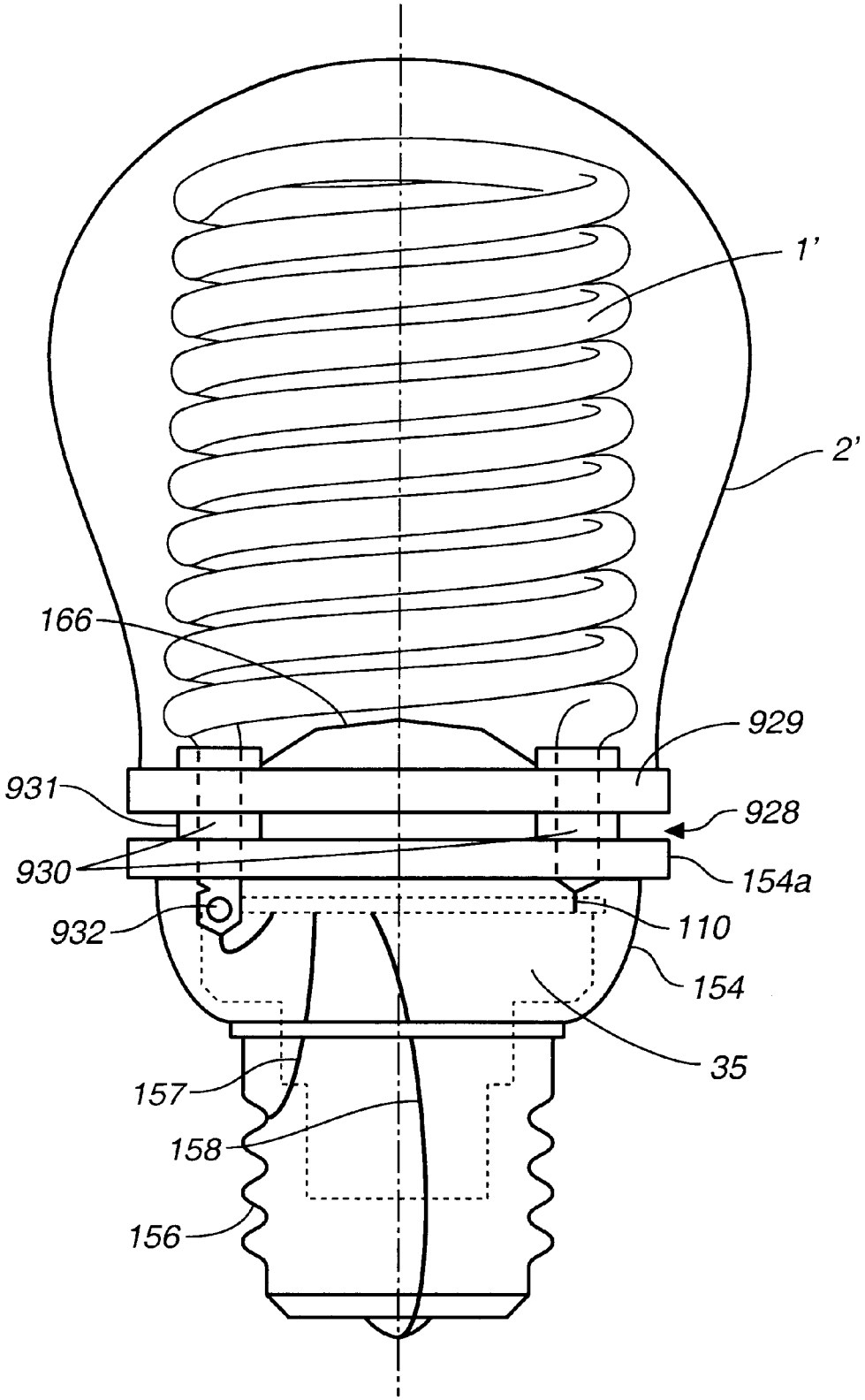
FIG. 29 is a side view of a CCFL device with a container for housing the CCFL, a housing for housing the driver with no holes in the housing and container, but has a gap between the housing and the container, and a mercury reservoir in a cold end of the CCFL envelope to illustrate another embodiment of the invention.

FIG. 29 shows another structure of the high power CCFL lamp. The bulb 2' and base plate 929 form an enclosed chamber so that small insects cannot enter. There is a gap 928 between base plate 929 and the top of driver housing 154*a*, for heat insulation between CCFL 1' and driver 35. The ends 930 of CCFL 1' extend through the connectors 931 into the driver housing 154 and are connected with the driver through leads 109 and 110. Since the driver does not consume much power and is at a lower temperature than the CCFL 1', the ends 930 are in a lower temperature area. Therefore they can act as cold ends for the CCFL. CCFLs contains liquid mercury in the envelope. Thus, at higher temperatures, more mercury will vaporize. At excessive temperatures for CCFL operation, there would be excessive mercury in the gaseous medium, so that the efficiency of the CCFL falls and so also does its life time. By placing a Hg alloy 932 at the cold end, even when the main body of the CCFL 1' is at an elevated temperature, the mercury in the alloy may still remain at a relatively lower temperature. Hg alloy 932 thus acts as a reservoir to control the Hg pressure in the CCFL 1' and the lower temperature of the alloy 932 determines how much mercury is in the gaseous medium. In other words, even at high temperatures, the effect of the alloy 932 is such that the amount of mercury in the medium still will not be excessive. This enables the CCFL to be operable at a high temperature.

While the invention has been described above by reference to various embodiments, it will be understood that changes and modifications may be made without departing from the scope of the invention, which is to be defined only by the appended claims and their equivalents. All references mentioned herein are incorporated in their entirety.

What is claimed is:

1. A cold cathode discharge device comprising:

a light transmissive envelope;

an ionizable gaseous medium in the envelope, said medium sustaining an electric discharge and emitting radiation in response to an electric field;

electrically conductive members, wherein at least one of the members is adjacent to and outside the envelope and electrically insulated from the medium;

a driver applying an AC voltage to the medium through said members, said AC voltage having a frequency in a range of about 10 to 100 kHz, causing gas discharge in the medium in the glow region.

2. The device of claim 1, wherein said envelope is vacuum sealed.

3. The device of claim 1, wherein said medium including a rare gas and mercury.

4. The device of claim 1, wherein said envelope includes a glass or quartz material, said device further comprising a fluorescent layer on the inside surface of the envelope.

5. The device of claim 1, wherein said members include layers of silver, graphite, tin oxide or indium tin oxide, and electrical contacts or wires connected to the layers.

6. The device of claim 1, wherein said AC voltage is in the range of about 100 to 10,000 volts.

7. The device of claim 1, further comprising a protection layer that contains MgO on the inside surface of the envelope.

8. The device of claim 7, wherein said envelope has a wall enclosing said medium, said MgO layer covering at least a portion of the wall adjacent to the members to protect said portions and to reduce cathode fall voltage.

9. The device of claim 1, wherein said envelope is elongated and has two ends, said members being located outside the envelope and one at or near each of the two ends of the envelope.

10. The device of claim 1, wherein said envelope is elongated and has two ends, said members being located outside the envelope with at least one member located away from the two ends, so that no gas discharge occurs within at least one section of the envelope.

11. A gas discharge device comprising:

at least one fluorescent lamp;

a driver supplying power to the at least one lamp to cause the at least one lamp to emit light;

a housing for the driver; and a light transmitting container containing said at least one lamp, said container connected to the housing forming a chamber to house the at least one lamp, each of said housing and said container defining a hole therein in communication with the chamber to allow air circulation through the chamber and the environment in order to dissipate heat generated by the at least one lamp.

12. The device of claim 11, wherein said container has two opposite ends with one end connected to the housing, and said hole in the container is located at or near the other end of the container.

13. The device of claim 12, wherein said housing has a portion adjacent to the chamber, said hole in the housing located in such portion of the housing, so that the air circulation will pass through the entire chamber.

14. The device of claim 11, wherein said housing includes a heat insulating plate shielding the driver from the chamber.

15. The device of claim 11, further comprising a connector electrically connected to the driver wherein said housing has a portion adjacent to the connector, and defines a hole in the housing located in such portion of the housing.

16. The device of claim 11, further comprising a light reflective surface on a portion of the housing facing the chamber.

17. The device of claim 11, wherein said container transmits light diffusedly or without scatter and comprises a glass or plastic material.

18. The device of claim 11, wherein said at least one fluorescent lamp includes a cold cathode fluorescent lamp.

19. The device of claim 11, wherein at least a portion of said at least one lamp is in the shape of a spiral.

20. The device of claim 11, further comprising a mesh inside the container covering the hole in the container.

21. A cold cathode gas discharge device comprising:

at least one cold cathode fluorescent lamp;

a driver supplying power to the at least one lamp to cause the at least one lamp to emit light;

a light transmitting container containing said at least one lamp;

an electrical connector; and a housing for the driver, said housing connecting the container and the connector, said housing having a first portion adjacent to the container and a second portion adjacent to the connector, said first portion having larger dimensions than the second portion.

22. The device of claim 21, said at least one cold cathode fluorescent lamp including two electrodes, wherein at least one of the electrodes extends into the housing.

23. The device of claim 21, comprising two or more cold cathode fluorescent lamps emitting light of the same or different wavelengths.

24. The device of claim 21, said container including optical elements, said elements including prisms and lenses.

25. The device of claim 21, further comprising a reflective layer on a portion of said container.

26. The device of claim 21, said driver extending into the connector so that the housing and the connector enclose the driver.

27. The device of claim 21, further comprising a light reflective surface on a portion of the housing facing the at least one lamp.

28. The device of claim 21, said housing defines therein a plurality of holes for air circulation to dissipate heat generated by the driver.

29. The device of claim 21, said container and said housing defining between them a sealed chamber for the at least one lamp.

30. The device of claim 21, further comprising a heat conductive and electrically insulating material holding the driver in place in the housing and insulating the driver from the connector, said material including glass, fiberglass, asbestos or mica.

31. The device of claim 21, wherein at least a portion of said at least one lamp is in the shape of a spiral.

32. A cold cathode gas discharge device comprising:

at least cold cathode fluorescent lamp, said at least one lamp in the shape of several rounds of a spiral;

a driver supplying power to the at least one lamp to cause the at least one lamp to emit light;

a housing for the driver, said at least cold cathode fluorescent lamp attached to the housing and electrically connected to the driver; and means for attaching at least two adjacent rounds of the at least one lamp to one another to increase mechanical strength of the device.

33. The device of claim 32, said attaching means including an adhesive material.

34. The device of claim 32, said attaching means attaching all adjacent rounds of the at least one lamp.

35. The device of claim 32, wherein at least a portion of said at least one lamp is in the shape of a spiral.

36. The device of claim 32, wherein at least one round of said at least one lamp has a different diameter than another round of the at least one lamp.

37. The device of claim 32, wherein said housing includes two protruding portions that enclose two ends of the at least one lamp.

38. The device of claim 32, wherein said housing defines at least one hole therein for air circulation to dissipate generated by the driver.

39. A cold cathode gas discharge device comprising:

at least one cold cathode fluorescent lamp;

a driver supplying power to the at least one lamp to cause the at least one lamp to emit light;

an open ended light transmitting container containing said at least one lamp; and a housing for the driver connected to the container.

40. The device of claim 39, said container defining at least one hole therein to improve air circulation in order to dissipate heat generated by the at least one lamp.

41. The device of claim 40, said container including a plastic or metal material.

42. The device of claim 40, said container being integral with and forms one unitary body with the housing.

43. The device of claim 40, said housing defining at least one hole therein to improve air circulation in order to dissipate heat generated by the driver.

44. The device of claim 43, said at least one hole having dimensions in the range of about 0.5 to 20 square mm.

45. The device of claim 40, said device including two or more cold cathode fluorescent lamps for generating light of the same or different wavelengths.

46. The device of claim 40, at least a portion of said at least one lamp having a shape of a spiral.

47. A cold cathode gas discharge device comprising:

at least one cold cathode fluorescent lamp;

a driver supplying power to the at least one lamp to cause the at least one lamp to emit light;

a light transmitting container containing said at least one lamp;

a housing for the driver connected to the container, said at least one lamp having a cylindrical envelope substantially in the shape of a spiral, said container comprising a first section adjacent to the housing and a second section away from the housing larger than the first section to enable holding a spiral lamp of larger diameter, so that said device has a light emitting window that is larger than 50% of the area enclosed by the spiral.

48. The device of claim 47 said first section including a metal material.

49. A cold cathode gas discharge device comprising:

at least one cold cathode fluorescent lamp, said at least one lamp having an envelope and one or more electrodes and mercury in the envelope;

a driver supplying power to the at least one lamp to cause the at least one lamp to emit light;

a light transmitting container containing said at least one lamp;

a holder for at least one electrode in the envelope, said holder catching sputtered material that includes mercury from the at least one electrode during operation of the device.

50. The device of claim 49, said holder including a metal material.

51. A cold cathode gas discharge device comprising:

at least one cold cathode fluorescent lamp, said at least one lamp having an envelope and one or more electrodes and mercury in the envelope, wherein at least one of the electrodes is substantially cylindrical in shape and has a portion in the envelope with a diameter substantially the same as an internal dimension of the envelope;

a driver supplying power to the at least one lamp to cause the at least one lamp to emit light; and a light transmitting container containing said at least one lamp.

52. The device of claim 51, wherein an outside surface of said at least one electrodes is in contact with inside surface of the envelope.

53. The device of claim 51, wherein said at least one of the electrodes is at least 10 mm in length.

54. A gas discharge device comprising:

at least one fluorescent lamp;

a driver supplying power to the at least one lamp to cause the at least one lamp to emit light;

a housing for the driver; and a light transmitting container containing said at least one lamp, said container separated from the housing by a gap.

55. The device of claim 54, wherein the lamp has an end that extends into the housing.

56. The device of claim 55, wherein said end contains a mercury alloy.

57. The device of claim 54, further comprising a base plate supporting the lamp, said plate and said container forming an enclosed chamber housing said lamp.

58. An electrode assembly for use in a cold cathode gas discharge system, including:

at least two electrode structures, each structure including at least two sub-electrodes, said sub-electrodes in each structure adapted to be connected in parallel to a driver; and a plurality of current limiting devices adapted to be connected between the sub-electrodes and the driver.

59. The assembly of claim 58, wherein each sub-electrode is connected through one of the plurality of current limiting devices to the driver.

60. The assembly of claim 58, wherein said system includes a housing, said plurality of current limiting devices located outside the housing.

61. The assembly of claim 58, wherein said system includes a housing, said plurality of current limiting devices located inside the housing.

62. The assembly of claim 58, said current limiting devices including capacitors and resistors.

63. The assembly of claim 61, wherein said sub-electrodes and capacitors and resistors comprise layers of material located adjacent to one another.

64. The assembly of claim 63, said layers of the sub-electrodes and capacitors and resistors are arranged in a stack forming a unitary body.

65. The assembly of claim 64, further comprising a shell enclosing said layers so that the layers in the body are securely connected to one another.

66. The assembly of claim 63, said layers of the capacitors and resistors being circular in shape.

67. The assembly of claim 58, each of said sub-electrodes including a lead and a n sub-electrode body, said assembly further comprising at least one electrically insulating tube enclosing a lead of a n sub-electrode to reduce probability of electrical shorting between such sub-electrode and other sub-electrodes.

68. The assembly of claim 58, each of said electrode structures including a plurality of sub-electrodes so that the system is adapted to deliver more than 5 watts of power.

69. The assembly of claim 58, each of said electrode structures comprising n sub-electrodes, n being an integer greater than 1.

70. A cold cathode gas discharge system, comprising:

at least two electrode structures, each structure including at least two sub-electrodes, said sub-electrodes in each structure adapted to be connected in parallel to a driver;

a housing containing at least a portion of said sub-electrodes; and a plurality of current limiting devices adapted to be connected between the sub-electrodes and the driver.

71. The system of claim 70, wherein each sub-electrode is connected through one of the plurality of current limiting devices to the driver.

72. The system of claim 70, said plurality of current limiting devices located outside the housing.

73. The system of claim 70, said plurality of current limiting devices located inside the housing.

74. The system of claim 70, said current limiting devices including capacitors and resistors.

75. The system of claim 74, wherein said sub-electrodes and capacitors and resistors comprise layers of material located adjacent to one another.

76. The system of claim 75, said layers of the sub-electrodes and capacitors and resistors are arranged in a stack forming a unitary body.

77. The system of claim 76, further comprising a shell enclosing said layers so that the layers in the body are securely connected to one another.

78. The system of claim 75, said layers of the capacitors and resistors being circular in shape.

79. The system of claim 70, each of said sub-electrodes including a lead and a n sub-electrode body, said system further comprising at least one electrically insulating tube enclosing a lead of a corresponding sub-electrode to reduce probability of electrical shorting between such sub-electrode and other sub-electrodes.

80. The system of claim 70, each of said electrode structures including a plurality of sub-electrodes so that the system is adapted to deliver more than 5 watts of power.

81. The assembly of claim 70, each of said electrode structures comprising n sub-electrodes, n being an integer greater than 1.

82. The system of claim 70, said system including a cold cathode fluorescent lamp.

83. A method for generating radiation by means of an electrode assembly in a cold cathode gas discharge system, including:

spreading current over at least two electrode structures, each structure including at least two sub-electrodes; and limiting the current passing through each sub-electrode so that current passing through each sub-electrode is not higher than a set threshold.

* * * * *